US006803715B1

(12) United States Patent
Mitsutake et al.

(10) Patent No.: US 6,803,715 B1
(45) Date of Patent: Oct. 12, 2004

(54) ELECTRON BEAM APPARATUS

(75) Inventors: Hideaki Mitsutake, Yokohama (JP); Hisao Tajima, Yokohama (JP); Yoshihisa Sanou, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,359

(22) Filed: Feb. 24, 2000

(30) Foreign Application Priority Data

Feb. 25, 1999 (JP) ..... 11-048895
Feb. 16, 2000 (JP) ..... 2000-038449

(51) Int. Cl.[7] ..... H01J 1/88
(52) U.S. Cl. ..... 313/495; 313/497; 313/411; 313/258
(58) Field of Search ..... 313/411, 412, 313/495, 497, 252, 258, 281, 496

(56) References Cited

U.S. PATENT DOCUMENTS

| | | | | |
|---|---|---|---|---|
| 4,363,648 A | | 12/1982 | Allaire et al. | 65/42 |
| 4,769,575 A | * | 9/1988 | Murata et al. | 313/495 |
| 5,952,775 A | * | 9/1999 | Sato et al. | 313/422 |
| 6,005,540 A | * | 12/1999 | Shinjo et al. | 345/74.1 |
| 6,144,154 A | * | 11/2000 | Yamazaki et al. | 313/495 |
| 6,265,822 B1 | * | 7/2001 | Kuroda et al. | 313/495 |
| 6,278,066 B1 | | 8/2001 | Fahlen et al. | 174/250 |
| 6,320,310 B1 | * | 11/2001 | Imai et al. | 313/497 |
| 6,342,754 B1 | * | 1/2002 | Kuroda et al. | 313/292 |
| 6,483,235 B1 | | 11/2002 | Iguchi et al. | 313/495 |

FOREIGN PATENT DOCUMENTS

| | | |
|---|---|---|
| JP | 57-118355 | 7/1982 |
| JP | 61-124031 | 6/1986 |
| JP | 64-31332 | 2/1989 |
| JP | 2-257551 | 10/1990 |
| JP | 4-28137 | 1/1992 |
| JP | 10-284284 | 10/1998 |
| JP | 10-294069 | 11/1998 |
| JP | 10-340793 | 12/1998 |

OTHER PUBLICATIONS

M. Elinson, et al. "The Emission of Hot Electrons and the Field Emissions of Electrons From Tin Oxide", Radio Engineering and Electronic Physics, Jul. 1965, pp. 1290–1298.

G. Dittmer, "Electrical Conduction and Electron Emission of Discontinuous Thin Films", Thin Solid Films, 9, 1972 pp. 317–328.

M. Hartwell et al., "Strong Electron Emission From Patterned Tin–Indium Oxide Films", IEDM, 1975, pp. 519–521.

H. Araki, et al., "Electroforming and Electron Emission of Carbon Thin Films", Journal of the Vacuum Soc. of Japan, vol. 2–6, No. 1, 1983, pp. 22–29 (with English Abstract on p. 22).

* cited by examiner

*Primary Examiner*—Alan Cariaso
*Assistant Examiner*—Ali Alavi
(74) *Attorney, Agent, or Firm*—Fitzpatrick, Cella, Harper & Scinto

(57) ABSTRACT

A spacer, which is an atmospheric pressure resistant structure for a vacuum container, can be easily assembled, and the manufacturing costs that accompany the installation of the spacer are reduced. A rear plate, which includes a substrate on which electron-emitting devices are mounted, is located opposite a face plate that is irradiated by electrons emitted by the electron-emitting devices, so that together these two units constitute one part of the vacuum container. A spacer is positioned as an atmospheric pressure resistant structure in the vacuum container. Blocks are bonded to both ends of the spacer, and with these blocks, the spacer is self-supported. Both ends of the spacer are tapered, and are used to reduce the stress that is imposed on the bottoms of the spacer and the blocks by the rear plate and the face plate while air is discharged from the vacuum container.

43 Claims, 22 Drawing Sheets

R: RED PHOSPHOR

G: GREEN PHOSPHOR

B: BLUE PHOSPHOR

ELECTRON BEAM APPARATUS

BACKGROUND OF THE INVENTION

1. Field of the Invention

The present invention relates to an electron beam apparatus wherein a first substrate, which includes an electron-emitting device, is positioned opposite a second substrate, for projecting an electron discharged by the electron-emitting device, and wherein a spacer is provided between the first substrate and the second substrate.

2. Related Background Art

Since a plane type display device is thin and light, it has been focused on as a replacement for a Braun tube display device. Especially for a display device that employs together an electron-emitting device and a phosphor that emits light when irradiated by an electron beam, a characteristic superior to that of conventional display devices of other types is expected. Compared with, for example, the liquid crystal display device that has been popular, a plane type display device is superior because a backlight is not required, it is a self-emission type and has a large viewing field angle.

Conventionally, there are two well known types of electron-emitting devices: a heat-cathode device and a cold-cathode device. As a cold-cathode device, for example, a surface conduction electron-emitting device, a field-emitting device (hereinafter referred to as a FE type), and a metal/insulating layer/metal emission device (hereinafter referred to as an MIM type) are known.

As a surface conduction electron-emitting device, for example, a device described by M. I. Elinson, Radio Eng. Electron Phys., 10 1290 (1965), and another device that will be described later are known.

The surface conduction electron-emitting device employs a phenomenon that permits electron emissions when a current flows in parallel to the surface of a small thin film that is formed on a substrate. As a surface conduction electron-emitting device, not only the device proposed by Elinson, which employs an $SnO_2$ thin film, but also a device that uses an Au thin film ("Thin Solid Films", G. Dittmer, 9, 317(1972)), a device that uses $In_2O_3/SnO_2$ ("IEEE Trans. ED Conf.", M. Hartwell and C. G. Fonstad, 519 (1975)), and a device that uses a carbon thin film ("Vacuum", Hisashi Araki et al., vol. 26, No. 1, 22 (1983)) have been reported.

As a specific example of the device arrangements for these surface conduction electron-emitting devices, FIG. 30 is a plan view of a device proposed by M. Hartwell, et al. In FIG. 30, an electroconductive thin film 3004 of metal oxide is formed in a flat H shape on a substrate 3001 by sputtering. An electron-emitting region 3005 is formed by performing, for the electroconductive thin film 3004, an operation called energization forming, which will be described later. In FIG. 30, an interval L is set to 0.5 to 1 mm and a width W is set to 0.1 mm. For convenience sake, the electron-emitting region 3005 is represented as having the rectangular shape shown in the center of the electroconductive thin film 3004; however, this shape is merely a specific example, and the actual position and shape of the electron-emitting region are not precisely shown.

Since when compared with a hot-cathode device a cold-cathode device emits electrons at a low temperature, it does not require a heater. Therefore, a cold cathode device is arranged more simply than is a hot-cathode device, and a delicate device can be fabricated. Further, even when multiple devices are arranged at a high density on a substrate, a problem such as the heat welding of the substrate seldom occurs. In addition, while the response speed of a hot-cathode device is low because to operate it must be heated by a heater, the response speed of the cold-cathode device is high.

Therefore, the study of the employment of a cold-cathode device has become very popular.

Since of the cold-cathode devices, the surface electroconductive electron-emitting device in particular is structured simply and is easily fabricated, and multiple devices can be formed in a across a wide area, methods for arranging and driving multiple devices are therefore studied, as is disclosed in Japanese Unexamined Patent Publication No. 64-31332, submitted by the present applicant.

Further, an image forming apparatus, such as an image display apparatus or an image recording apparatus, and an electron beam apparatus, such as a charge beam source, are studied for application with a surface conduction electron-emitting device.

An image display apparatus that employs both a surface conduction electron-emitting device and a phosphor that emits light when an electron collision occurs is: especially studied as an example application, as is disclosed by the present applicant in U.S. Pat. No. 5,066,883 and Japanese Patent Publications No. 2-257551 and No. 4-28137.

FIG. 31 is a perspective view of an example display panel that serves as a flat panel image display, with one part of the panel cut away in order to show the internal structure. In FIG. 31, reference numeral 3115 denotes a rear plate; 3116, a side wall; and 3117, a face plate. The rear plate 3115, the side wall 3116 and the face plate 3117 form an envelope (an airtight container) to maintain a vacuum inside the display panel.

A substrate 3111 is fixed to the rear plate 3115, and cold-cathode devices 3112 are arranged in an N×M matrix shape on the substrate 3111 (N and M are positive integers of two or greater, and are determined as needed in accordance with the target number of display pixels). As is shown in FIG. 31, the N×M cold-cathode devices 3112 are laid out along M lines of row-directional wiring 3113 and N lines of column-directional wiring 3114. The portion constituted by the substrate 3111, the cold-cathode devices 3112, the row-directional wiring 3113 and the column-directional wiring 3114 is called a multi-electron beam source. At least at portions where the lines of row-directional wiring 3113 and the lines of column-directional wiring 3114 intersect, insulating layers (not shown) are formed between lines of wiring, and electric insulation is maintained.

A phosphor film 3118, which is prepared using phosphors, is deposited on the lower surface of the face plate 3117, and phosphors (not shown) in three primary colors, red (R), green (G) and blue (B), are painted on it. Further, a black member (not shown) is located between the individual phosphors that constitute the phosphor film 3118, and a metal backing 3119 composed of Al, etc., is formed on the surface of the phosphor film 3118, near the rear plate 3115.

$D_{x1}$ to $D_{xM}$, $D_{y1}$ to $D_{yN}$ and Hv are airtight electric terminals used to electrically connect the display panel to an electric circuit (not shown). $D_{x1}$ to $D_{xM}$ are electrically connected to the lines of row-directional wiring 3113 of the multi-electron beam source; $D_{y1}$ to $D_{yM}$, are electrically connected to the lines of column-directional wiring 3114 of the multi-electron beam source; and Hv is electrically connected to the metal back 3119.

A vacuum of approximately 1.3×10-3 [Pa] (10-6 [Torr]) is maintained inside the airtight container, and as the display area of the image display apparatus is increased, means is required to prevent the deformation or the destruction of the rear plate 3115 and the face plate 3117, which could occur due to the pressure difference between the inside and the outside of the airtight container. A method according to which the rear plate 3115 and the face plate 3116 are thickened not only results in an increase in the weight of the image display apparatus, but also in the distortion of an image or parallax when viewed obliquely, whereas structure support members (called spacers or ribs) 3120 formed of a comparatively thin glass plate, as shown in FIG. 31, provide support and resist the atmospheric pressure. With this arrangement, normally an interval of a submilimeter or several millimeters is maintained between the substrate 3111, on which the multi-beam electron source is mounted, and the face plate 3117, on which the phosphor film 3118 is deposited. As is described above, this contributes to the maintenance of a high vacuum inside the airtight container.

In an image display apparatus that employs the thus described display panel, when a voltage is applied to the cold-cathode devices 3112 via the external container terminals $D_{x1}$ to $D_{xM}$ and $D_{y1}$ to $D_{yN}$, electrons are emitted by the cold-cathode devices 3112. At the same time, a high voltage of several hundred Vs to several kVs is applied to the metal back 3119, via the external container terminal Hv, to accelerate the emitted electrons so that they collide with the internal wall of the face plate 3117; As a result, the individual color phosphors of the phosphor film 3118 are excited and emit light, and an image is displayed.

For the following reason, the spacers 3120 positioned inside the display panel are required to have high insulation and high electrification suppression capabilities so that they can resist the high voltages that are is applied to the face plate 3117 and the rear plate 3115.

First, when a part of the electrons emitted by the cold-cathode devices 3112 near a spacer 3120 strike the spacer 3120, or when the electrons of that part which reach and are reflected by the face plate 3117 strike the spacer 3120, a secondary electron emission occurs, and this may result in the electrification of the spacer 3120. In accordance with information obtained by the present applicant, in most cases a positive charge is induced on the surface of a spacer 3120. Then, since the spacer 3120 is charged, the trajectories of electrons emitted by the cold-cathode device 3112 are bent, and the electrons arrive at positions on the phosphor on the phase plate 3117 that differ from the normal position. As a result, near the spacer a displayed image is distorted.

Second, since a high voltage of several hundred Vs or more (i.e., a high electric field of 1 KV/mm or greater) is applied between the multi-electron beam source and the face plate 3117 in order to accelerate electrons that are emitted by the cold-cathode devices 3112, a creeping discharge can occur on the surface of a spacer 3120. Especially when a spacer 3120 is charged as described above, a discharge may be induced.

To resolve this problem, one proposal provides for the supply of a micro-current to a spacer to remove a charge (Japanese Unexamined Patent Publications No. 57-118355 and No. 61-124031). Thus, according to this proposal a thin film having high resistance is formed, as a charge prevention film, on the surface of an insulating spacer to supply a micro-current to the surface of the spacer. The charge prevention film used here is a tin oxide thin film, a thin film composed of a mixture of crystal of tin oxide and indium oxide, or an island-shaped metal film.

Further, in the proposal presented by the present applicant, for a preferable electrical connection of a spacer, on which a film having a high resistance is deposited, to a multi-electron beam source and a face plate, an arrangement is also disclosed for the forming of films at those connection joints. In addition, an arrangement is disclosed wherein, by using conductive frit glass, a spacer on which a film having high resistance and a film having low resistance are deposited is electrically connected to the multi-electron beam source and the face plate, and wherein the spacer is mechanically fixed.

SUMMARY OF THE INVENTION

In the display panel of the image display apparatus described above, since a plurality of spacers are arranged in accordance with the display size of the display panel and the thicknesses of the rear plate and the face plate, the number of spacers increases as the display size is enlarged. Accordingly, in the assembly process for the display panel, since the number of procedures required for installing spacers is increased, the manufacturing costs are increased. Further, especially when spacers are elongated, the warping of spacers opposite the rear plate and the face plate is a problem that can not be ignored. That is, when such a warp occurs, great stress is imposed on a spacer that is sandwiched between the rear plate and the face plate, and the spacer may be broken. Therefore, the yield of the spacers during the assembly of the display panel progressively affects the yield of the display panels, and accordingly, manufacturing costs rise.

To form the envelope for the display panel, generally, the face plate, the side wall and the rear plate are sealed by using frit glass. At this time, frit glass is annealed by heating the envelope to approximately 400 to 500° C. Because of this heat, a spacer may be expanded relative to the face plate and the rear plate, and be deformed or misaligned.

Further, when a charge prevention film and a film that is used for the preferable electrical connection of the charge prevention film to the electron beam source and the face plate are to be formed on the surface of a spacer, if the spacer is extended in consonance with the size of a display panel, for the films, desired thicknesses and positional accuracy can not be obtained, and desired effects can not be acquired.

Furthermore, when, as is described above, a plurality of types of films are to be formed on the surface of a spacer, the number of film formation procedures is increased, and the films must be formed so that a satisfactory electroconductivity is attained without an oxide film, etc., being formed between the films.

It is a first objective of the present invention to provide an electron beam apparatus, in which spacers are employed, that can be easily assembled, so that the rise in manufacturing costs that accompanies the installation of spacers can be suppressed.

It is a second objective of the present invention to provide an electron beam apparatus that can prevent the destruction of a spacer when it is sandwiched between a rear plate and a face plate.

It is a third objective of the present invention to provide an electron beam apparatus wherein a spacer is prevented from being deformed or misaligned due to the heat used to form a vacuum container for the electron beam apparatus.

It is a fourth objective of the present invention to provide an electron beam apparatus wherein, even with an elongated spacer, a desired film can be formed on the surface of the spacer to prevent charging.

It is a fifth objective of the present invention to obtain electroconductivity even among a plurality of films that are formed on the surface of a spacer and to minimize the increase in the number of procedures.

To achieve the above objectives, an electron beam apparatus according to the present invention is characterized by comprising:

a first substrate that is provided in a vacuum container and that includes a plurality of electron-emitting devices;

a second substrate that in the vacuum container is located opposite the first substrate and that is irradiated by electrons emitted by the electron-emitting devices;

one spacer, at least, that is mounted as an atmospheric-pressure resistant structure on one of the first and the second substrates, that is sandwiched directly between the first and the second substrates, or indirectly via an intermediate member between the first and the second substrates, and that is extended longitudinally in a direction perpendicular to the direction in which the first and the second substrates are positioned opposite each other; and a support member, for supporting the spacer outside an electron-emitting region that is defined between a region of the first substrate wherein the electron-emitting devices are located, and a region of the second substrate that is irradiated by the electrons, wherein at least the spacer or the support member has a structure that relieves the stress that is generated when the spacer is sandwiched between the first and the second substrates.

According to the above invention, the interval between the first and the second substrates is maintained by spacers. Since the spacers are self-supported by support members, the positioning of the spacers during the assembly of an electron beam apparatus is easy. Further, since the support members support the spacers outside the electron-emitting region, the space required for the support members need not be taken into account when the electron-emitting devices are to be arranged.

If warping of a spacer occurs, especially if the spacer and a support member are secured to each other, when the spacer is sandwiched between the first and the second substrates, the stress that is generated to straighten the warped spacer is concentrated at that portion whereat the spacer and the support member are secured to each other. But since at the least, either the spacer or the support member is so designed that it can reduce stress, the destruction of the spacer can be prevented. The present invention is particularly effective when the longitudinal length of a spacer is 50 times or greater the interval (the distance between the top end and the bottom end of the spacer) maintained by the spacer. Further, the effects are particularly outstanding when the longitudinal length is 100 times or greater.

Further, an electron beam apparatus according to the present invention is characterized by comprising:

a first substrate that is provided in a vacuum container and that includes a plurality of electron-emitting devices;

a second substrate that in the vacuum container is located opposite the first substrate and that is irradiated by electrons emitted by the electron-emitting devices;

one spacer, at least, that is mounted as an atmospheric-pressure resistant structure on one of the first and the second substrates, that is sandwiched directly between the first and the second substrates, or indirectly via an intermediate member between the first and the second substrates, and that is extended longitudinally in a direction perpendicular to the direction in which the first and the second substrates are positioned opposite each other; and a support member that, outside an electron-emitting region that is defined between a region of the first substrate wherein the electron-emitting devices are located and a region on the second substrate that is irradiated by the electrons, is mounted on the substrate whereon the spacer is provided so that the support member supports the spacer, wherein the support member and the spacer are secured to each other, so that a first axis of the support member, which is positioned parallel to the face of the support member that is mounted on the substrate; is substantially parallel to a second axis of the spacer that is extended in the longitudinal direction.

According to the second invention, the support member is mounted on the first or the second substrate and the spacer is fixed to the support member, so that the longitudinal axis is substantially parallel to the mounting face. Therefore, during the assembly of the electron beam apparatus, the stress that is generated at the portion to which the spacer and the support member are fixed can be minimized when the spacer is sandwiched between the first and the second substrates.

Furthermore, an electron beam apparatus according to the present invention is characterized by comprising:

a first substrate that is provided in a vacuum container and that includes a plurality of electron-emitting devices;

a second substrate that in the vacuum container is located opposite the first substrate and that is irradiated by electrons emitted by the electron-emitting devices;

one spacer, at least, that is mounted as an atmospheric-pressure resistant structure on one of the first and the second substrates, that is sandwiched directly between the first and the second substrates, or indirectly via an intermediate member between the first and the second substrates, and that is extended longitudinally in a direction perpendicular to the direction in which the first and the second substrates are positioned opposite each other; and a support member, for supporting the spacer outside an electron-emitting region that is defined between a region of the first substrate wherein the electron-emitting devices are located, and a region of the second substrate that is irradiated by the electrons, wherein the spacer has a thermal expansion rate that is smaller than the substrate on which the spacer is mounted.

The electron beam apparatus may heat a vacuum container in order to acquire a vacuum container or to enhance the degree of vacuum provided by the vacuum container. The individual members are thermally expanded by heating. But according to the third invention, since the spacer has a smaller thermal expansion rate than the substrate on which the spacer is mounted, the positional shifting of the spacer, which is caused by the distortion that occurs when the length of the spacer is longer than the substrate, can be prevented.

However, when there is too great a difference between the thermal expansion rates of the substrate and the spacer, the substrate expands too much and a force produced by tension acts on the spacer. Thus, it is preferable that the difference between the thermal expansion rates of the substrate and the spacer be not greater than 5%.

In addition, an electron beam apparatus according to the present invention is characterized by comprising:

a first substrate that is provided in a vacuum container and that includes a plurality of electron-emitting devices;

a second substrate that in the vacuum container is located opposite the first substrate and that is irradiated by electrons emitted by the electron-emitting devices; and one spacer, at least, that is mounted as an atmospheric-pressure resistant structure on one of the first and the second substrates, that is sandwiched directly between the first and the second substrates, or indirectly via an intermediate member between the first and the second substrates, and that is extended longitudinally in a direction perpendicular to the direction in which the first and the second substrates are positioned opposite each other, wherein a film, which is to be electrically connected to either the first substrate or the electrode and is not to be charged as easily as the surface of the spacer, is formed on the surface of the spacer at a plurality of portions in the longitudinal direction of the spacer.

According to the fourth invention, on the surface of a spacer a film is formed that is electrically connected either to the electrode that controls the electrons emitted by the electron-emitting devices, or to the first substrate. Therefore, the charging of the surface of the spacer that is accompanied by the emission of electrons is removed. Further, since this film is formed at a plurality of portions in the longitudinal direction of the spacer, the film formation accuracy relative to the position, the shape and the thickness of the film is improved, and a desired film can be obtained.

Moreover, an electron beam apparatus according to the present invention is characterized by comprising:

a first substrate that is provided in a vacuum container and that includes a plurality of electron-emitting devices;

a second substrate that in the vacuum container is located opposite the first substrate and that is irradiated by electrons emitted by the electron-emitting devices; and one spacer, at least, that is mounted as an atmospheric-pressure resistant structure on one of the first and the second substrates, that is sandwiched directly between the first and the second substrates, or indirectly via an intermediate member between the first and the second substrates, and that is extended longitudinally in a direction perpendicular to the direction in which the first and the second substrates are positioned opposite each other, wherein on the surface of the spacer are formed a highly resistant film, which is electrically connected either to the first substrate or to the electrode and which is not charged as easily as the surface of the spacer, and a low resistant film, which is laminated over or under the highly resistant film in the electrically connected region and which has a sheet resistance smaller than the highly resistant film, and wherein the highly resistant film and the low resistant film contain the same metal elements but have different compositions.

According to the fifth invention, the highly resistant film and the low resistant film are deposited on the surface of a spacer. The charging of the spacer surface is removed by the highly resistant film, while the electric connection of the highly resistant film and the first substrate or the electrode is satisfactorily effected by the low resistant film, and the trajectory of electrons that are emitted by the electron-emitting device near the spacer is controlled. Since the highly resistant film and the low resistant film contain the same elements but have different compositions, a satisfactory continuity is maintained at the boundary between the low resistant film and the highly resistant film, and a desired low resistant film and a desired highly resistant film can be sequentially formed by using the same film formation device. Especially when these films are to be deposited by the vapor-phase film deposition method, the films can be deposited in the same chamber without the vacuum atmosphere being adversely affected. Thus, an unwanted oxide film is not formed at the lamination of the low resistant film and the highly resistant film.

DETAILED DESCRIPTION OF THE PREFERRED EMBODIMENTS

Figure 1:
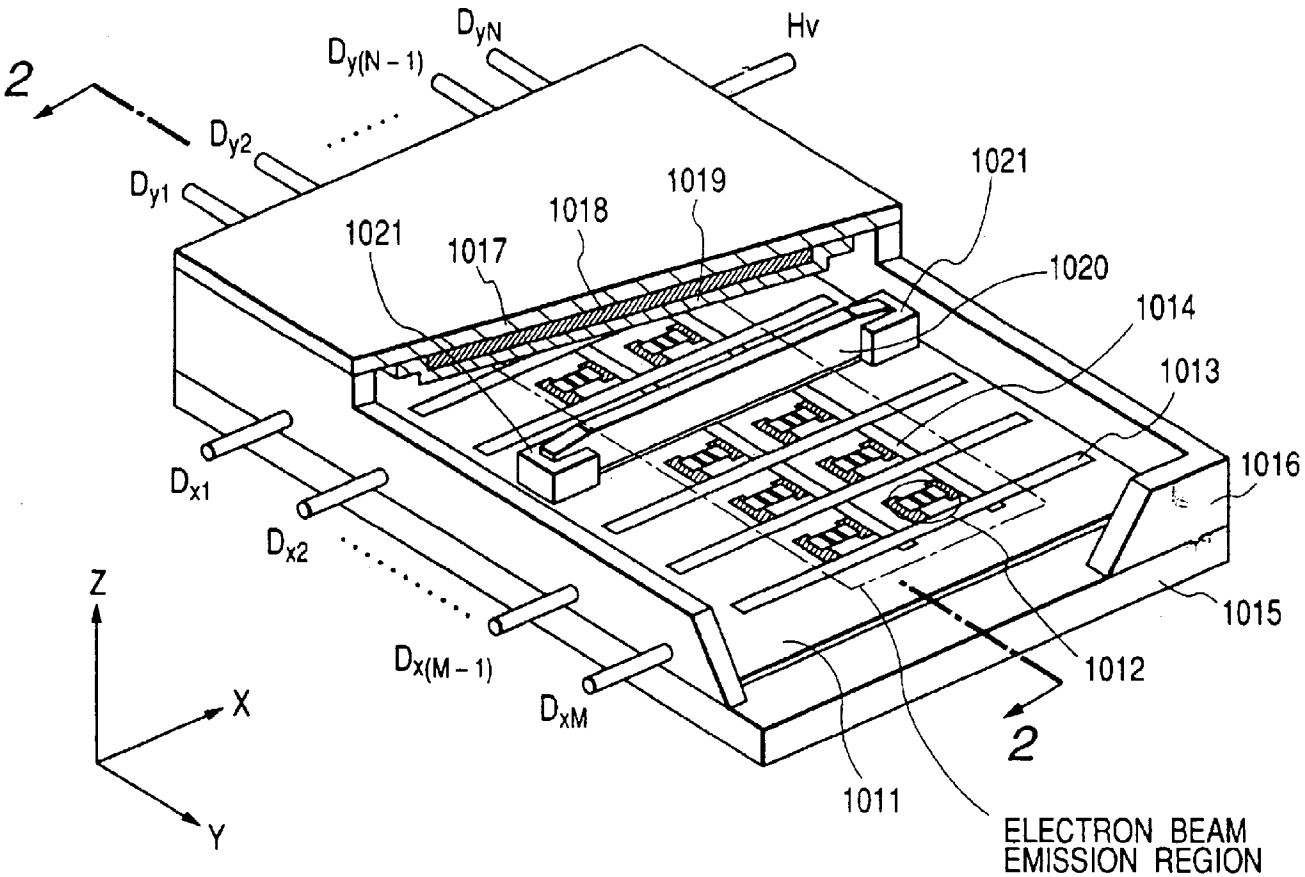
FIG. 1 is a perspective view of the external appearance of a display panel, for an image display apparatus, according to a first mode of the present invention.

The modes of the present invention will now be described while referring to the drawings.

(First Mode)

FIG. 1 is a perspective view of the external appearance of a display panel according to a first mode, for an image display apparatus to which the present invention is applied. In order to illustrate the internal structure, the display panel is partially cut away.

As is shown in FIG. 1, the envelope (airtight container) for maintaining a vacuum inside the display panel is constituted by a rear plate 1015, a side wall 1016 and a face plate 1017. Further, inside the airtight container, a spacer 1020 is provided as an atmospheric pressure resistant structure. It should be noted that FIG. 1 is a conceptual drawing, and the actual length of the spacer in the longitudinal direction (X direction) is 100 times or more the height (the distance in direction Z).

A substrate 1011 is fixed to the rear plate 1015, and M and N cold-cathode devices 1012 are arranged in a matrix shape on the substrate 1011. The cold-cathode devices 1012 are connected by M lines of row-directional (X-directional) wiring 1013 and N lines of column-directional (Y-directional) wiring 1014.

A phosphor film 1018 and a metal back 1019 are formed on the surface of the face plate 1017, near the rear plate 1015. For a display panel used for a color display device, as the phosphor film 1018, phosphors of three primary colors, red, green and blue, are painted following a predetermined pattern. For a display panel used for a monochrome display device, a phosphor of one color is used as a phosphor film. The metal back 1019 is provided mainly as an electrode for applying an electron accelerated voltage.

Figure 2:
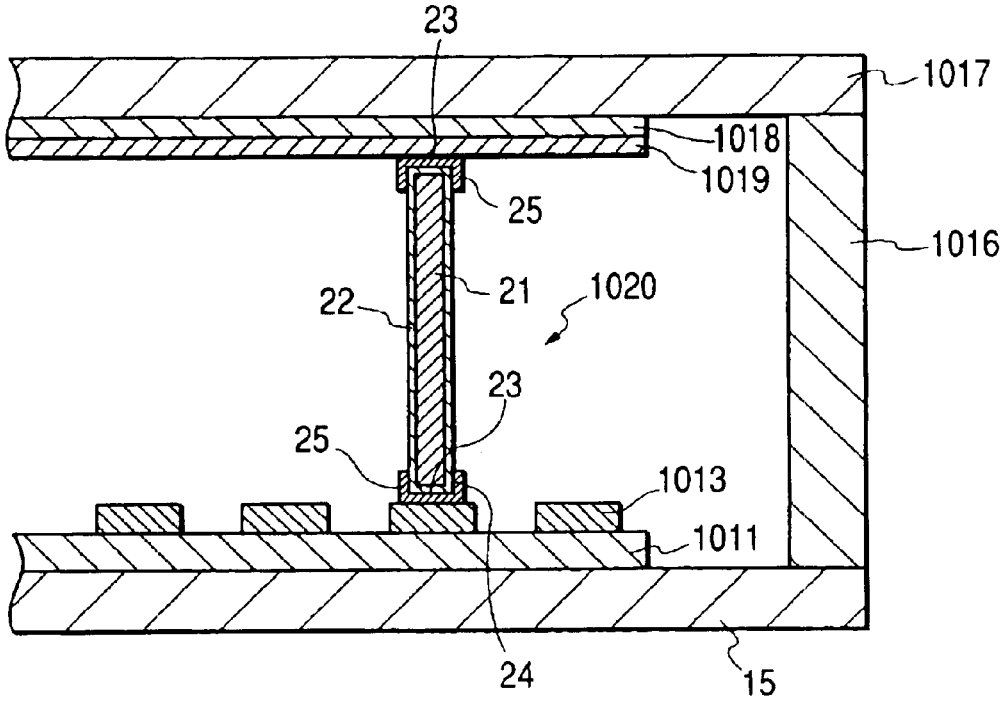
FIG. 2 is a specific cross-sectional view of the display panel in FIG. 1 taken along line 2—2.

As is shown in FIG. 2, the spacer 1020 is formed by depositing a highly resistant film 22 on the surface of a thin, insulating base plate 21, and by depositing a low resistant film 25 on a surface 23 that faces the inside surface of the face plate 1017 (the metal back 1019) and that faces the surface of the substrate 1011 (the row-directional wiring 1013). The highly resistant film 22 is electrically connected via the low resistant film 25 to the metal back 1019 and the row-directional wiring 1013. Furthermore, as is shown in FIG. 1, the spacer 1020 is arranged parallel to the row direction (the direction X). Both ends of the spacer 1020 are extended upwards outside the region (the electron-emitting region) that is sandwiched between the region in which the cold-cathode devices 1012 of the substrate 1011 are provided and the region in which the phosphor 1018 of the face plate 1011 is deposited, and are secured at predetermined positions inside the envelope.

In the region outside the electron-emitting region, a block 1021, which is a self-supported mechanism, is fixed at both ends of the spacer 1020, and the spacer 1020 is self-supported by the block 1021. Since after the envelope is formed during the assembly process, which will be described later, the spacer 1020 is held between the face plate 1017 and the rear plate 1015 by the pressure exerted by a force, the block 1021 need only maintain the spacer 1020 in a vertical position relative to the substrate face until the envelope is formed.

Therefore, it is preferable that the block 1021 be fixed to the substrate 1011 in order to prevent the positional shifting of the spacer 1020 until the envelope is formed. However, so long as the positional shifting of the spacer 1020 is prevented until the envelope is formed, the block 1021 need not always be fixed to the substrate 1011. Furthermore, the spacer 1020 may be fixed to the face plate 1017, instead of to the substrate 1011.

Figure 3:
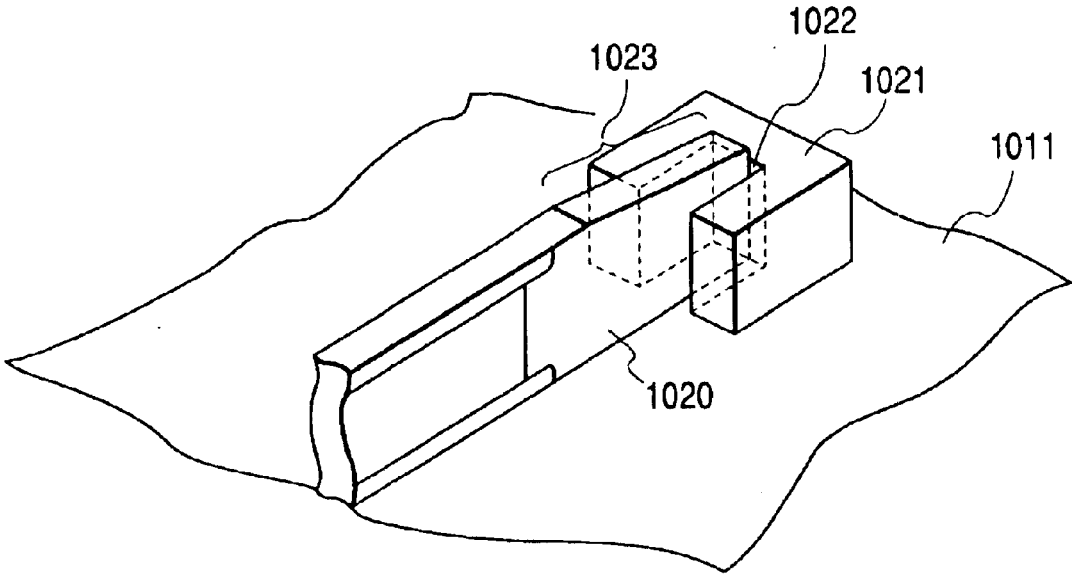
FIG. 3 is a perspective view of the vicinity of the fixed portion of a spacer in FIG. 1.

The structure of the fixed portion of the spacer 1020 will now be described while referring to FIGS. 3, 4A and 4B. FIG. 3 is a perspective view of the vicinity of the fixed portion of the spacer in FIG. 1, and FIGS. 4A and 4B are a side view and a plan view of the vicinity of the fixed portion of the spacer in FIG. 1.

Figure 4A:
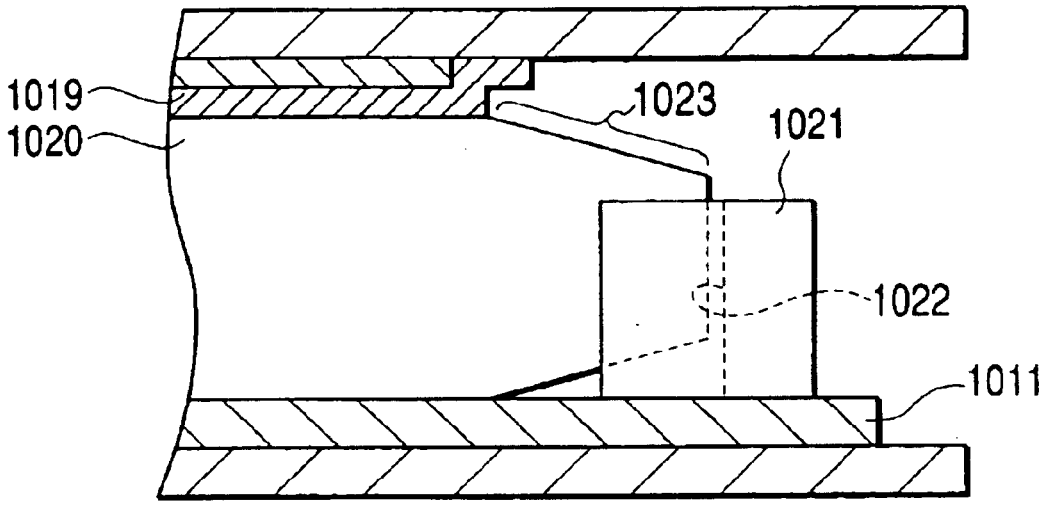
FIGS. 4A and 4B are a side view and a plan view of the vicinity of the fixed portion of the spacer in FIG. 1.
Figure 4B:
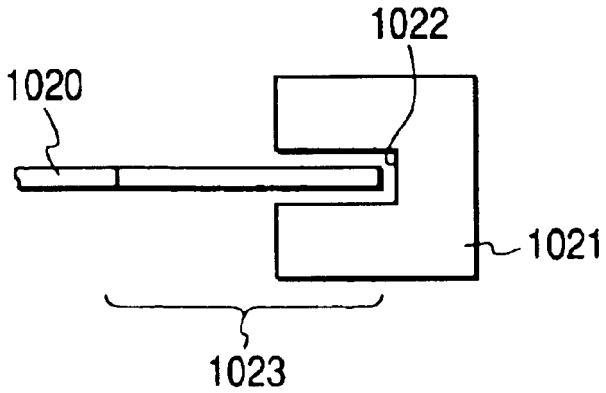

As is shown in FIGS. 3, 4A and 4B, the spacer 1020 is tapered at both ends in the region outside the electron-emitting region. This tapered portion serves as a non-contact portion 1023 that does not contact the substrate 1011 and the metal back 1019. A groove 1022, into which the longitudinal end of the spacer 1020 is to be inserted, is formed in the side face of the block 1021. Before the block 1021 is fixed to the substrate 1011, the longitudinal end of the spacer 1020 is inserted into the groove 1022 and is bonded to the block 1021 by an adhesive. The block 1021 is shorter than the spacer 1020 in height.

The processing for fabricating the display panel in FIG. 1 according to this mode will now be described. Since the processing for fabricating the electron beam substrate 1011 will be described later, an explanation will be given here mainly for the process for assembling the individual parts.

(1) The spacer 1020 is securely bonded to the block 1021.

Figure 5:
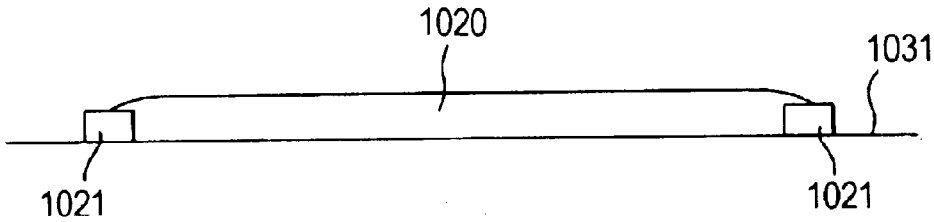
FIG. 5 is a diagram for explaining the relationship of the spacer and a block when the two are secured to each other.

At this time, an appropriate alignment of the positions and of angles is required, so that the spacer 1020 is not obliquely grounded relative to the face plate 1017 and the rear plate 1015 when a vacuum discharge that will be described later is performed. Furthermore, it is preferable that the bottom of the spacer 1020 be on the same plane as the bottoms of the two blocks 1021 that are fixed to the ends of the spacer 1020, so that the blocks 1021 can effectively function as a self-supporting mechanism when the spacer 1020 is grounded on the substrate 1011. For this arrangement, a tool, as is shown in FIG. 5, is employed that has a reference face 1031 on the same plane. While the blocks 1021 and the spacer 1020 are mounted on the reference face 1031 of the tool, the blocks 1021 and the spacer 1020 are securely bonded together, so that the bottoms of the spacer 1020 and the blocks 1021 can be easily set on the same plane.

(2) The spacer 1020 is positioned on the substrate 1011.

The positioning of the spacer 1020 is performed by using a positioning tool (not shown) in the electron-emitting region or in an outside region. Since the blocks 1021 are fixed to the spacer 1020, the spacer 1020 is maintained self-supported by the blocks 1021. In this state the spacer 1020 is merely placed on the substrate 1011. So long as the unalignment of the spacer 1020 is prevented until the process for forming the envelope, which will be descried later, is completed, the blocks 1021 need not be fixed to the substrate 1011. However, when the unalignment may be caused, the blocks 1021 may be fixed to the substrate 1011 using an adhesive, etc.

(3) An envelope is formed.

The face plate 1017 and the rear plate 1015 are fully aligned, and the juncture of the face plate 1017, the side wall 1016 and the rear plate 1015 is heated and sealed by using frit glass to form an envelope. As a result, the top and the end faces of the spacer 1020 are closely attached to the metal back 1019 and the substrate 1011, respectively, and the spacer 1020 is not completely, but to a degree maintained between the metal back 1019 and the substrate 1011 by the pressure produced by the force that is exerted by the metal back 1019 and the substrate 1011.

(4) Vacuum discharge and sealing is performed for the envelope.

After the envelope has been formed, air is discharged from inside the envelope via an exhaust pipe (not shown), and when a sufficient degree of vacuum is attained, the exhaust pipe is closed. That is, after the vacuum discharge has been completed, the spacer 1020 is securely fixed at a predetermined position inside the envelope by the atmospheric pressure that is externally exerted on the envelope. When the exhaust pipe has been closed, a voltage is applied to the individual wiring that is formed on the substrate 1011, which will be described later in detail, and the cold-cathode devices 1012 are formed.

Figure 6:
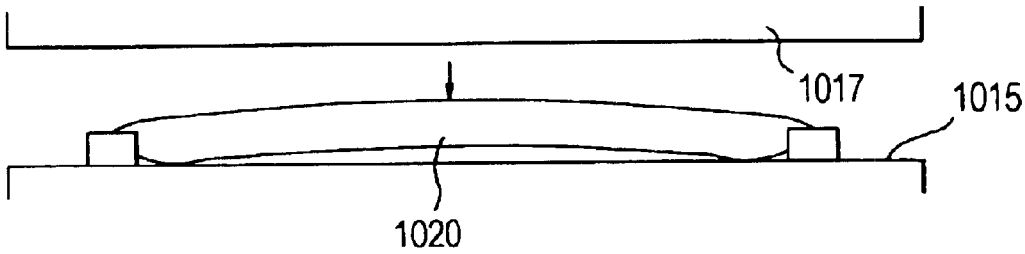
FIG. 6 is a diagram for explaining the reshaping of a warped spacer using vacuum discharge in an envelope.

Assuming that, for example, as is shown in FIG. 6, the spacer 1020 is warped and is raised at its longitudinal center (although actually the warp value would be several $\mu$m to several hundred $\mu$m, to simplify the explanation, the shape of the spacer 1020 is exaggerated in FIG. 6). When the face plate 1017 and the rear plate 1015 are to be sealed together, the highest portion of the spacer 1020 is pressed against by the face plate 1017 and is reshaped. If the spacer 1020 is held while the warping is not corrected, not only will the spacer 1020 be unstable, but also the electrical connection of the high resistant film 22 to the metal back 1019 and the row-directional wiring 1013 will not be satisfactory.

As the spacer 1020 is being reshaped, the blocks 1021 that are fixed to the ends of the spacer 1020 tend also to be displaced (in FIG. 6, the blocks 1021 are lifted away from the rear plate 1015). Since the blocks 1021 are shorter than the spacer 1020 in height, the blocks 1021 can be displaced to a degree, and as a result, the display panel can be fabricated while the spacer 1020 is being reshaped.

When the warping of the spacer 1020 exceeds a permissible range for the displacement of the blocks 1021, the spacer 1020 can not be stably fixed, and provided with a preferable electrical connection, unless the relative position or the relative angle is changed at the portion whereat the spacer 1020 and the block 1021 are fixed together. In this mode, however, as described above, the two ends of the spacer 1020 are the non-contact portions 1023, which are deformed more easily than the other portions. Therefore, even when the warping of the spacer 1020 exceeds the permissible, range for the displacement of the blocks 1021, the non-contact portions 1023 can be deformed within a permitted deformable range, without being destroyed.

As a result, the stress that occurs during the vacuum discharge at the portion where the blocks 1021 are fixed to the spacer 1020 is dispersed at the non-contact portions 1023, and the destruction of the spacer 1020 is therefore prevented. Thus, the yields of the spacers 1020 and the display panels in the display panel assembly process can be improved. This is effective especially for a long spacer 1020 that tends to be warped. When the spacer 1020 is greatly warped, the spacer 1020 is also reshaped to a degree during the envelope forming process. Also, at this time the non-contact portions 1023 of the spacer 1020 function effectively.

In addition, since the blocks 1021 are located outside the electron-emitting region, the blocks 1021 do not adversely affect the characteristics of the cold-cathode devices 1012 (see FIG. 1) and the trajectories of electrons that are emitted by the cold-cathode devices 1012. Further, since the space for mounting the blocks 1021 need not be taken into account when arranging the cold-cathode devices 1012, the cold-cathode devices 1012 can be arranged close together, and a high-resolution image can be displayed.

Various materials, such as glass, ceramics and plastic, can be employed for the blocks 1021. It is preferable that a material possess sufficient heat-resistance to resist the heat applied during the process for fabricating the display panel, and have a thermal expansion rate that is near those of the substrate 1011, the face plate 1017 and the spacer 1020.

It is also preferable that an adhesive used for bonding the blocks 1021 and the spacer 1020, and an adhesive used for bonding the blocks 1021 to the substrate 1011 have sufficient heat resistance to resist the above heat, and have a thermal expansion rate near those of the substrate 1011, the face plate 1017 and the spacer 1020.

In this example, blocks 1021 are fixed to both ends of a spacer 1020. However, so long as the spacer 1020 can be self-supported, blocks 1021 need not always be fixed to both ends of the spacer 1020, and one may be fixed to only one end. When a block 1021 is fixed to one end of the spacer 1020, the non-contact portion 1023 need only be formed at the end whereat the block 1021 is fixed. However, when the positioning must be performed particularly accurately for a long spacer 1020, it is preferable that blocks 1021 be fixed to both ends of the spacer 1020.

Figure 7:
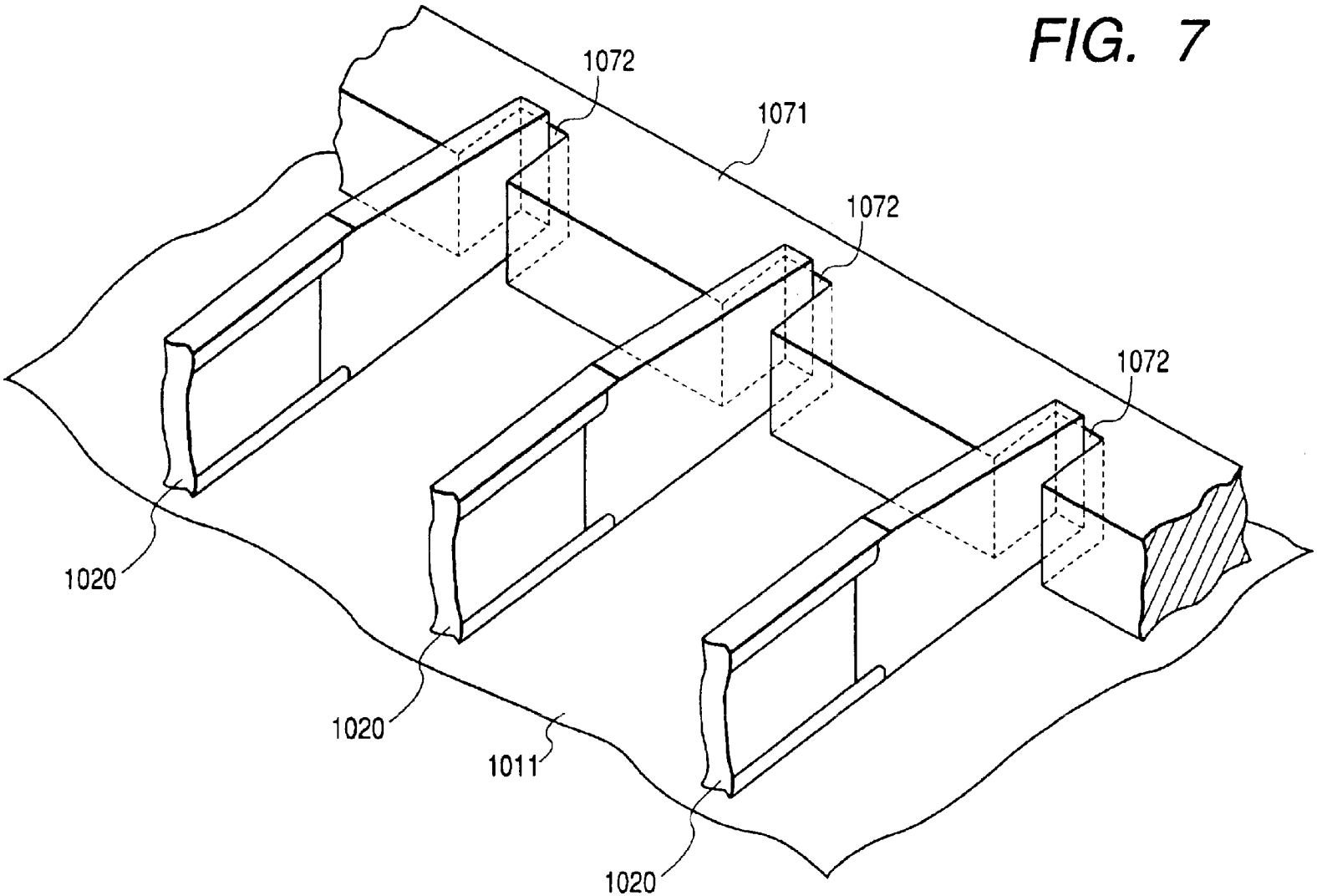
FIG. 7 is a perspective view of one modification of the block for the first mode in FIG. 1, showing the vicinity of the fixed portions of a plurality of spacers that are supported by one block.

In this mode, the spacer 1020 is supported one by one by the blocks 1021. However, as is shown in FIG. 7, a long block 1071 in which a plurality of grooves 1072 are formed at the same pitch may be employed, so that a plurality of spacers 1020 can be supported by one block 1071. Therefore, since the spacers 1020 can be handled as a single piece when mounted on the substrate 1011, the task of handling and positioning the spacers 1020 is easy. In this case also, a block 1071 may be fixed to only one end of the spacer 1020, or blocks 1071 may be fixed to both ends.

Furthermore, in this mode, the non-contact portions 1023 of the spacer 1020 are tapered. However, the non-contact portions 1023 are not limited to the tapered shape, and can be formed in other shapes so long as they do not contact the metal back 1019 and the substrate 1011.

Figure 8:
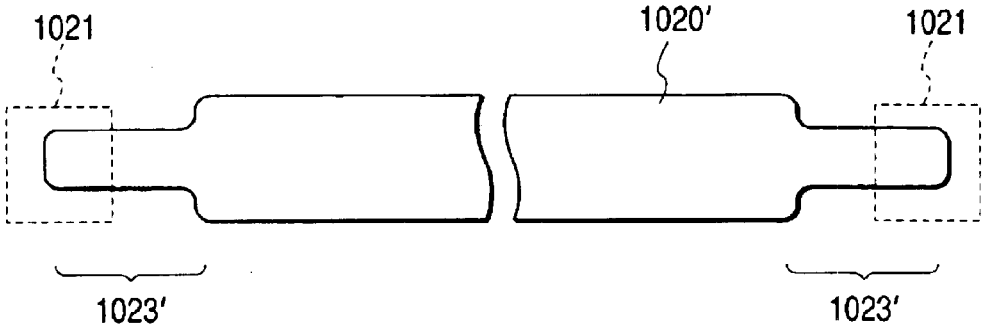
FIG. 8 is a side view of one modification of the non-contacting portions of the spacer according to the mode in FIG. 1.

For example, for a spacer 1020' in FIG. 8, both ends are narrower than the other portions and serve as non-contact portions 1023'. Since, for a spacer 1020 like this, only a little stress is generated relative to bending, the spacer 1020 is less often destroyed. For a spacer 1020" in FIG. 9, the R process (rounding process) is performed for the corners at both ends, which are defined as non-contacting portions 1023". Thus, even when a corner abuts against the metal back 1019 or the substrate 1011 during the reshaping of the spacer 1020", the spacer 1020" is seldom chipped because the corners are rounded off. If the spacer 1020" is formed of glass or ceramics, to prevent chipping it is preferable that the curvature radius of a corner be equal to or greater than 10 $\mu$m.

The spacers with R-processed corners are not limited to spacers whose corners have been processed to increase the curvature radius, but also include spacers for which a desired curvature is obtained when the spacers (base members) are formed.

In the above example, a spacer includes non-contact portions to reduce the stress that is exerted on the portion whereat the spacer and the blocks are secured to each other. The non-contacting portions are not always so designed that they do not contact the rear plate and the face plate, as is shown in FIGS. 4A, 4B, 8 and 9. The non-contacting portions may contact either the rear plate or the face plate, so long as they can reduce the stress during the display panel assembly process, and can thus prevent the destruction of the spacer.

(Second Mode)

Figure 10:
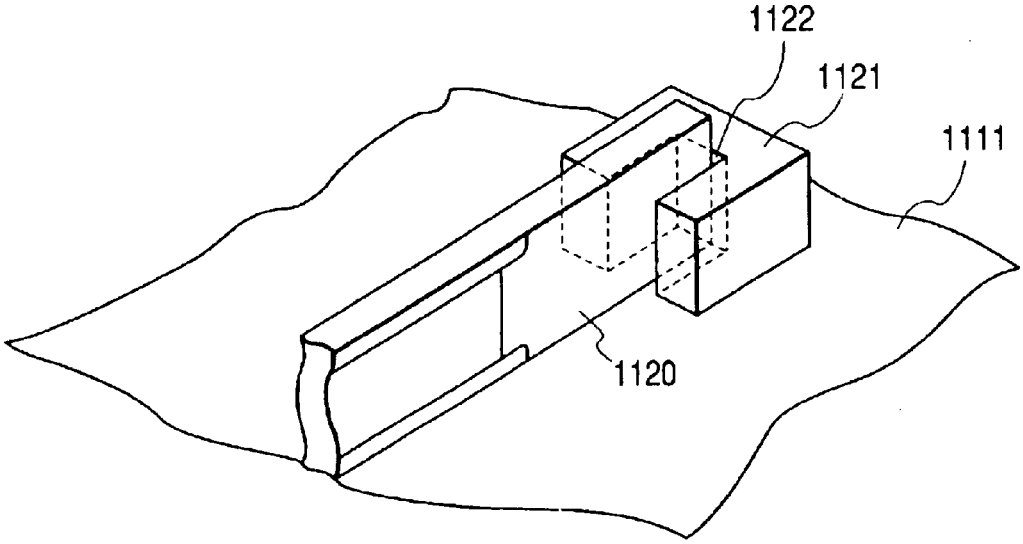
FIG. 10 is a perspective view of a portion for supporting a spacer according to a second mode of the present invention.
Figure 11:
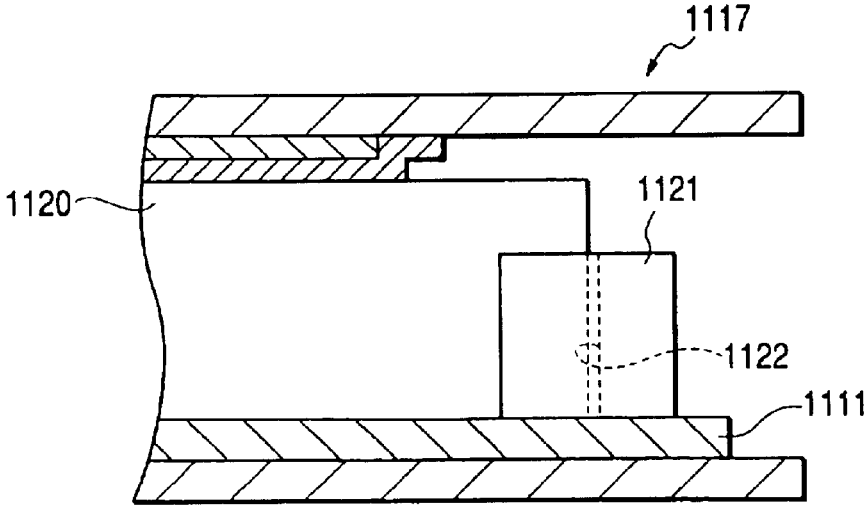
FIG. 11 is a side view of the support portion for the spacer in FIG. 10.

FIG. 10 is a perspective view of a portion for supporting a spacer according to a second mode of the present invention, and FIG. 11 is a side view of the support portion for the spacer in FIG. 10.

In this mode as well as in the first mode that was explained while referring to FIG. 3, etc., a spacer 1120 is supported and positioned by blocks 1121 that are located outside an electron-emitting region, and is secured inside an envelope by vacuum discharge. A difference from the first mode is that the spacer 1120 is not fixed to the blocks 1121, and that both ends are merely inserted into grooves 1122.

Specifically, in the process for assembling a display panel, first, the blocks 1121 are fixed to a substrate 1111, and then the ends of the spacer 1120 are inserted into the grooves 1122 of the blocks 1121. At this time, the spacer 1120 and the blocks 1121 are not secured to each other. Thereafter, in the same manner as in the first mode, formation of an envelope, vacuum discharge, and the formation of cold-cathode devices are preformed.

In this mode, since the spacer 1120 is not fixed to the blocks 1121, when the spacer 1120 abuts against the face plate 1117 at the time the envelope is being formed, or when vacuum discharge is performed for the envelope, the spacer 1120 can be deformed within its permissible deformable range, without being destroyed and without being restricted by the blocks 1121. That is, when the warped spacer 1120 is reshaped relative to the substrate 1111 and the face plate 1117, the stress that is generated can be dispersed not only at the ends of the spacer 1120 but also across the entire length. As a result, destruction of the spacer 1120 can more effectively be prevented.

As is described above, since the spacer 1120 is not fixed to the blocks 1121 in this mode, the non-contact portions in the first mode need not be formed at the ends of the spacer 1120, and the spacer 1120 can be a thin plate having a simple rectangular belt shape. It is preferable, however, that the R-process be performed for corners in order to prevent the chipping of the corners of the spacer 1120 when the warping is corrected.

(Third Mode)

This mode employs material that is different from the material used to form blocks for the above described modes. Since the shapes of the blocks and the spacers are the same as those in the second mode, the third mode will be described while referring to FIGS. 10 and 11, which were employed for the second mode.

In this mode, blocks 1121 are formed of a resin, such as acrylic resin. One or both ends of spacers 1120 are inserted into grooves 1122 of blocks 1121, and are fixed to the blocks 1121 by an epoxy adhesive. The acrylic resin and the epoxy adhesive are softer than a glass substrate or a ceramic substrate that constitutes the base member of the spacer 1120. That is, even when the relative positioning or relative angle between the blocks 1121 and the spacer 1120 is changed during the display panel assembly process, the stress that is generated can be dispersed by the blocks 1121, and accordingly, the destruction of the spacer 1120 can be prevented. Furthermore, since the acrylic resin and the epoxy adhesive are softer, or are decomposed or evaporated, depending on the temperature of the heat applied during the formation of the envelope, further effects for dispersing the stress can be obtained.

In this mode, a thin spacer 1120 having a simple rectangular belt shape has been employed. However, if non-contacting portions are provided for the spacer as in the first mode, the stress generated during the assembly of the display panel can be dispersed not only to the blocks 1121, but also to the non-contacting portions. Therefore, the destruction of the spacer 1120 is more effectively prevented.

(Fourth Mode)

Figure 12:
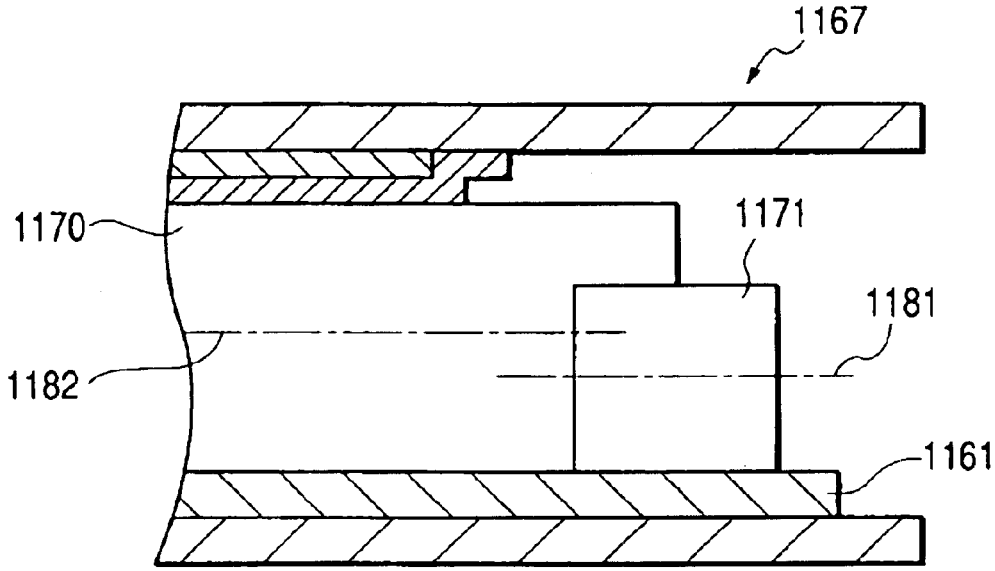
FIG. 12 is a side view of the fixed portion of a spacer according to a fourth mode of the present invention.

FIG. 12 is a side view of a portion for supporting a spacer according to a fourth mode of the present invention.

In this mode, as well as in the first and the third modes, blocks 1171 are fixed to one end or both ends of spacers 1170. However, the reduction of the stress, which is generated during the display panel assembly at a portion whereat a spacer 1170 and blocks 1171 are secured to each other, depends not on the end shape of the spacer 1170 and the material used for the blocks 1171, but on the regulation of the positional relationship between the spacer 1170 and the blocks 1171.

Specifically, in FIG. 12 a first virtual axis 1181 is set for the block 1171 that is parallel to the face of the block 1171 that contacts a substrate 1161, and a second virtual axis 1182 is set for the spacer 1170 that is extended in the longitudinal direction. In this case, while the face plate 1167 and the rear plate are assembled with the spacer 1170 between them, the spacer 1170 and the block 1171 are fixed together, so that the first axis 1181 and the second axis 1182 are substantially parallel. The other arrangement, where the blocks 1171 are shorter in height than the spacer 1170 and the blocks 1171 may be mounted not on the substrate 1161 but on the face plate 1167, is the same as the first mode.

Figure 13:
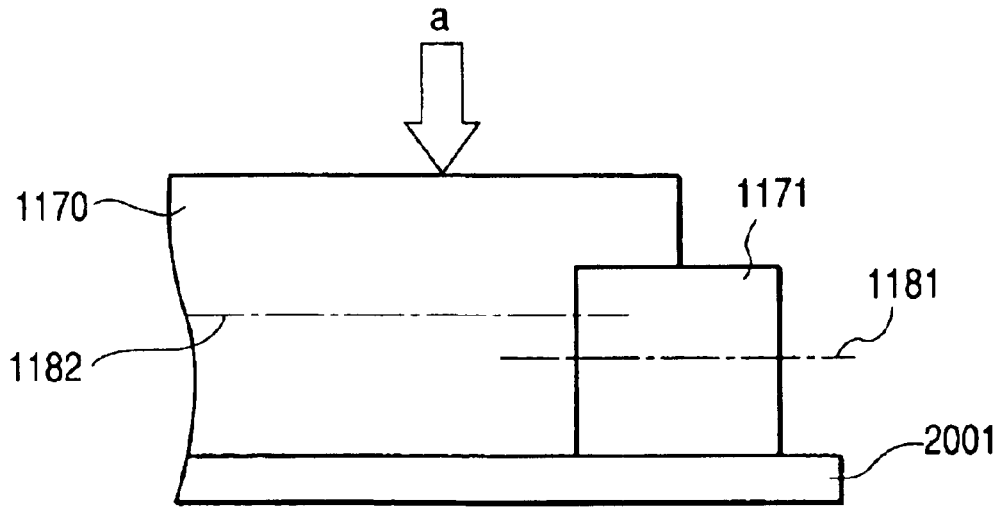
FIG. 13 is a diagram for explaining one example method for fixing the spacer according to the fourth mode of the present invention.

The following method, for example, may be employed to fix the spacer 1170 to the block 1171, so that the first axis 1181 and the second axis 1182 are substantially parallel. FIG. 13 is a diagram for explaining an example method for fixing the spacer according to the fourth mode of the invention. First, the block 1171 is placed on a flat table 2001 and the spacer 1170 is mounted so that the end of the spacer 1170 engages a groove (not shown) in the block 1171. As is indicated by an arrow a, a load perpendicular to the block mounting face of the flat table 2001 is imposed on the end of the spacer 1170, and the spacer 1170 is pressed against the flat table 2001. Thus, the first axis 1181 is parallel to the second axis 1182. While this state is maintained, the block 1171 and the spacer 1170 are secured using an appropriate adhesive. The easiest method by which to impose such a load is to place a weight on the spacer 1170.

When the spacer 1170 is fixed to the block 1171 in this manner, during the assembly of a display panel, only minimum stress is generated at the portion whereat the spacer 1170 and the block 1171 are secured, so that the destruction of the spacer 1170 can be prevented.

Figure 14:
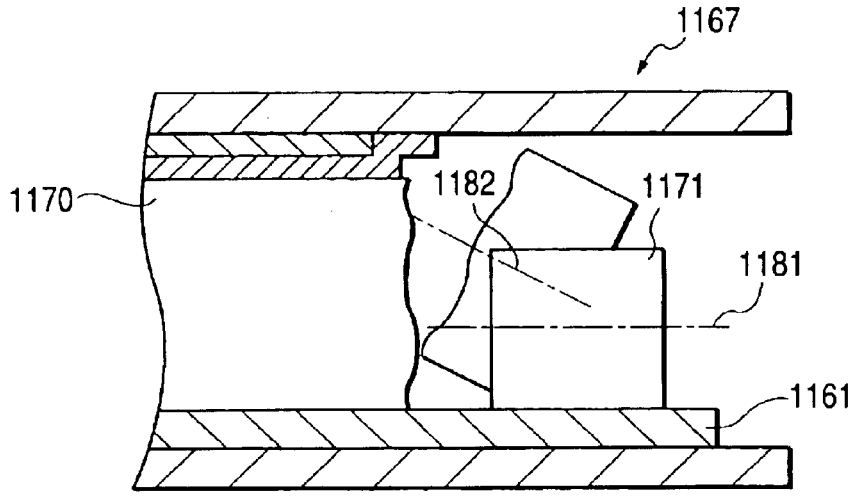
FIG. 14 is a side view of the fixed portion of the spacer when the spacer is destroyed because the first axis of a block is not parallel to the second axis of the spacer.

If, as is shown in FIG. 14, the spacer 1170 is fixed to the block 1171 while the first axis 1181 is not substantially parallel to the second axis 1182, during the assembly of a display panel, the spacer 1170 will be broken by the stress (especially the tension stress) that is generated at the portion fixed to the block 1171.

In FIG. 5, which is referred to in the first mode, is shown a spacer 1020 that is not warped. When the spacer is not warped, as in this example, the spacer 1020 and the block 1021 are aligned on the reference face 1031, so that the first axis and the second axis are substantially parallel, as in this mode. When the spacer 1020 is warped, as in FIG. 6, the spacer 1020 and the block 1021 must be secured to each other, so that the axis of the spacer 1020 is parallel to the first axis in the vicinity of the portion of the spacer 1020 that is fixed to the block 1021.

(Fifth Mode)

This mode can be applied for the first to the third modes described above, and employs an insulating base member that constitutes a spacer and that has a smaller thermal expansion rate than a substrate and a face plate. Therefore, when the structure is heated during the assembly of the display panel, thermal expansion of the spacer does not exceed the expansion of the face plate or the substrate. As a result, it is possible to prevent the distortion of a spacer that is due to a thermal expansion rate that differs from that of the face plate or the substrate, and to prevent non-alignment due to a distorted spacer. If a difference in the thermal expansion ratios of the spacer to the substrate or the face plate is too large, the spacer may be destroyed and the substrate or the face plate may be warped. Therefore, it is preferable that the difference in the thermal expansion rate of the insulating base member not exceed 5%.

(Sixth Mode)

Figure 15:
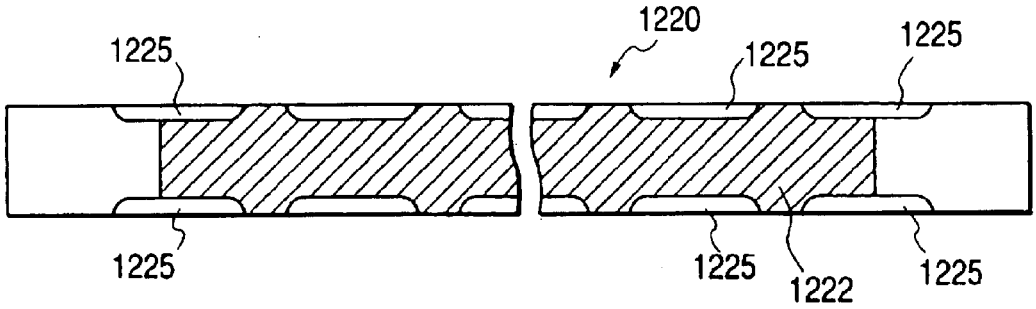
FIG. 15 is a side view of a spacer according to a fifth mode of the present invention.

FIG. 15 is a side view of a spacer according to a fifth mode of the present invention.

In this mode, a low resistance film 1225 is formed on the top and the bottom of a spacer 1220, not overall in the longitudinal direction, but at a plurality of positions. With this arrangement, control of the thickness and the positioning of the low resistance film 1225 can be performed more accurately. This arrangement is especially effective for a long spacer 1220. Various film deposition methods, including a vapor-phase film deposition method, such as evaporation or sputtering, and a liquid-phase film deposition method, such as printing or spraying, can be employed. In FIG. 15, the low resistance film 1225 is formed at separate positions; however, a high resistance film 1222, or both a high resistant film 1222 and a low resistance film 1225 may be formed at a plurality of positions.

Assume that w is defined as the permissible interval for a plurality of low resistance film segments 1225, h is defined as the height of the low resistance film (an electrode formed on the spacer) 1225, and d is defined as the distance between the electron-emitting device, which is nearest the spacer 1220, and the spacer 1220. When d is greater than h, w is preferably about five times ($d \times (d/h)$) or smaller. When h is equal to or greater than d, w is preferably equal to or smaller than five times d. In either case, more preferably, d is about two times or smaller. If this condition is satisfied, the distortion of the trajectory of an electron that is emitted by an electron-emitting device can be ignored.

An explanation will now be given, while referring to FIGS. 16A and 16B, for a method for forming the low resistance film 1225 on the top and bottom of the spacer 1220.

Figure 16A:
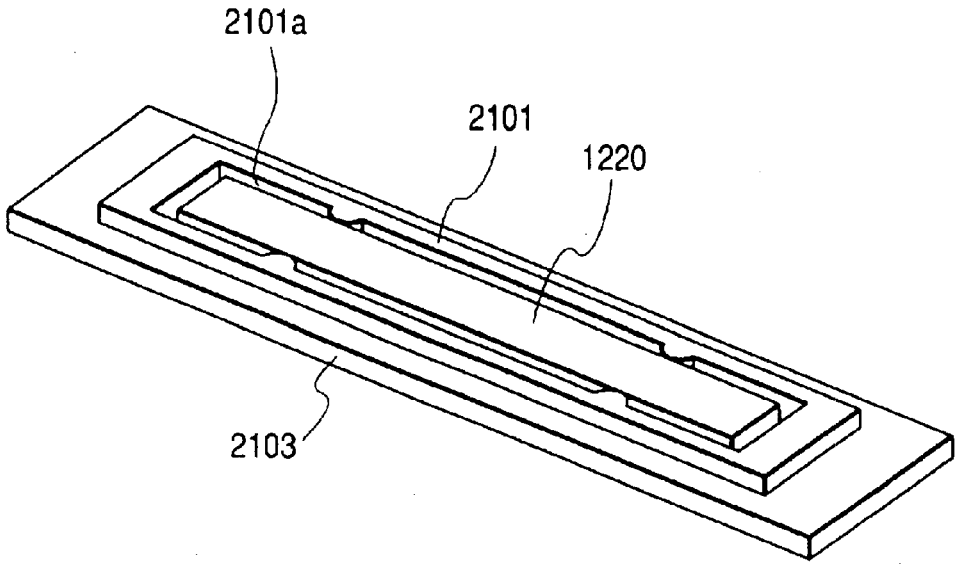
FIGS. 16A and 16B are diagrams for explaining an example method for forming a low resistant film for the spacer in FIG. 15.

(Step 1) First, as is shown in FIG. 16A, a first metal mask 2101, having an opening 2101*a* to which the substrate that serves as the spacer 1220 can be fitted, is prepared. Then, the spacer 1220 is fitted into the opening 2101*a* of the first metal mask 2101, and the resultant structure is mounted on a flat table 2103. The first metal mask 2101 and the spacer 1220 have substantially the same thickness.

Figure 16B:
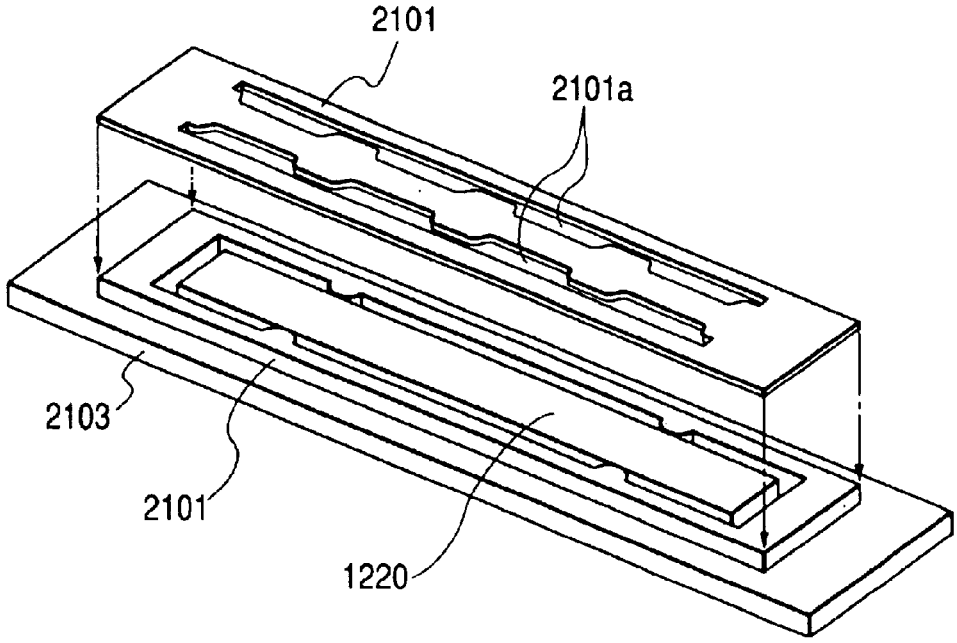

(Step 2) Then, as is shown in FIG. 16B, a second metal mask 2102, which has an opening 2102*a* that corresponds to the outline of the low resistance film 1225 (see FIG. 15) to be formed, is positioned overlapping the first metal mask 2101 to which the spacer 1220 is fitted. At this time, exercising a desired precision, the first metal mask 2101 is aligned with the second metal mask 2102.

The first metal mask 2101 can be fixed to the second metal mask 2102 by employing a magnetic material to form both metal masks 2101 and 2102, and employing a permanent magnetic material to form the flat table 2103.

(Step 3) Finally, while the metal masks are aligned, the flat table 2103 is placed in the chamber of a sputtering device, and the vacuum discharge is performed for the chamber. Then, the low resistance film 1220 is deposited by sputtering.

The above steps are performed for the obverse and the reverse faces of the spacer 1220, so that the spacer 1220 having the low resistance film 1220 in FIG. 15 can be obtained.

(Seventh Mode)

Figure 17:
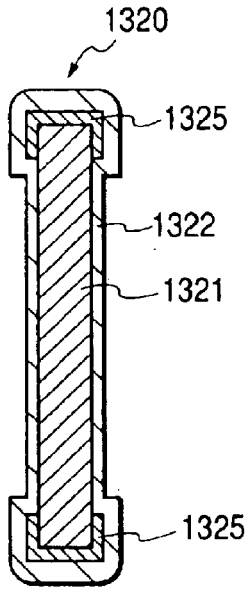
FIG. 17 is a vertical cross-sectional view of a spacer according to a sixth mode of the present invention.

FIG. 17 is a vertical cross-sectional view of a spacer according to a sixth mode of the present invention.

In this mode, a low resistance film 1325 is deposited on the ends of the top and bottom sides of an insulating base member 1321, and a high resistance film 1322 is used to cover all surfaces of the insulating base member 1321 on which the low resistant film 1325 has been deposited, so that a spacer 1320 is obtained. While the low resistance film 1325 and the high resistance film 1322 contain the same element, but have different compositions in order to obtain a desired sheet resistance. For example, when the low resistance film 1325 is a Cr film, the high resistance film 1322 is a Cr—Al film. When the same element is contained in the low resistance film 1325 and the high resistance film 1322, a preferable continuity is maintained at the boundary of the low resistance film 1325 and the high resistance film 1322, and satisfactory electroconductivity is ensured between the two films.

In addition, when the vapor-phase deposition method is employed, the same film deposition method can be employed to sequentially deposit the low resistance film 1325 and the high resistance film 1322 that contain the same element.

An explanation will now be given, while referring to the flowchart in FIG. 18, for example processing for depositing the low resistant film 1325 and the high resistant film 1322 using the vapor-phase film deposition method.

First, when the insulating base member 1312 is placed in the chamber of the film deposition device, a low resistance film deposition mask is set (step 101). Then, vacuum discharge is performed for the chamber (step 102), and Cr is sputtered (step 103). As a result, a low resistance film 1325 made of Cr is deposited on the insulating base member 1321. When the low resistance film 1325 has been formed, the low resistance film deposition mask is retracted to a position where the next film formation is not interfered with (step 104), and Cr-Al is sputtered (step 105). As a result, a high resistance film 1322 made of Cr—Al is deposited across the entire surface of the insulating base member 1321 on which the low resistance film 1325 has been formed. When the high resistance film 1322 has been formed, the chamber is opened in the atmosphere (step 106), and the spacer 1320, for which the low resistance film 1325 and the high resistance film 1322 are deposited, is extracted from the chamber.

In the above described manner, the low resistance film 1325 and the high resistance film 1322 can be sequentially deposited using the same film deposition device, without disturbing the vacuum atmosphere in the chamber. Therefore, the throughput for manufacturing a spacer 1320 can be dramatically improved, and the deposit of an unwanted oxide film between the low resistance film 1325 and the high resistance film 1322 can be prevented. With this arrangement, satisfactory electrical conductivity is also ensured between the low resistance film 1325 and the high resistance film 1322.

In the example in FIG. 17, the high resistance film 1322 is formed while the low resistance film 1325 is covered. However, this mode can be applied in a case, as in the first mode, wherein the high resistance film is formed on the insulating base member and the low resistance film is deposited thereafter.

(Other Modes)

The essential modes of the present invention have been described. Another mode that can be applied for the modes of the present invention and modifications of the individual modes will now be described. When not specifically mentioned in the following explanation, the following modifications can be applied for the above modes.

(Arrangement and manufacturing method for display panel)

An explanation will now be given, while referring to FIG. 1, etc., for a specific example of the arrangement and manufacturing method used for the display panel of the image display apparatus that employs the present invention.

As was explained in the first mode, the envelope is constituted by the rear plate 1015, the side wall 1016 and the face plate 1017. To assemble the airtight container, the individual members must be closed in order to obtain sufficient strength and to provide an adequate airtight condition at the joints. This sealing can be performed, for example, by coating the joints with frit glass and by annealing the structure in the air or in a nitrogen atmosphere at 400 to 500° C. for at least ten minutes. Since a vacuum of 1.3×10-3 [Pa] (10-6 [Torr]) is maintained inside the airtight container, spacers 1020 are provided as atmospheric pressure resistant structures in order to protect the airtight container from being deformed by atmospheric pressure or from being destroyed by an unexpected impact.

The electron source substrate of this invention is obtained by arranging a plurality of cold cathode devices on the substrate. The arrangement of the cold cathode devices includes: a ladder-like arrangement (hereinafter referred to as a ladder-like electron source substrate), in which cold cathode devices are arranged in parallel and both ends of each device are connected by wiring; and a simple matrix arrangement (hereinafter referred to as a matrix electron source substrate), in which lines of X directional wiring and lines of Y directional wiring are connected together for each pair of device electrodes for each cold cathode device. An image-forming apparatus that includes a ladder-like electron source substrate requires a control electrode (a grid electrode) that controls the flight of electrons from an electron-emitting device.

The matrix wiring will be described here as an example.

The substrate 1011, which is an electron source substrate, is fixed to the upper face of the rear plate 1015. The N×M cold cathodes 1012 are arranged in a matrix shape on the substrate 1011. N and M are positive integers of two or greater, and are determined as needed in accordance with the target number of display pixels. For example, for a display device for a high-quality television display, it is preferable that a value of N=3000 or greater and a value of M 1000 or greater be set. The N×M cold cathode devices 1012 are arranged in a simple matrix of M lines of the row-directional wiring 1013 and N lines of the column-directional wiring 1014. In this example, the portion that is constituted by the substrate 1011 and the cold cathode devices 1012, and the lines of wiring 1013 and 1014, which are mounted on the substrate 1011, is called a multi-electron beam source.

For the multi-electron beam source used for this invention, no limitations are set for the material, the shape or the fabrication method for the cold cathode device 1012. Therefore, for example, a surface conduction electron-emitting deice, or a cold cathode device of an FE type or an MIM type, can be employed.

An explanation will now be given for the structure of a multi-electron beam source when surface conduction electron-emitting devices (which will be described later) are arranged as the cold cathode devices 1012 on the substrate, and simple matrix wiring is provided.

Figure 19:
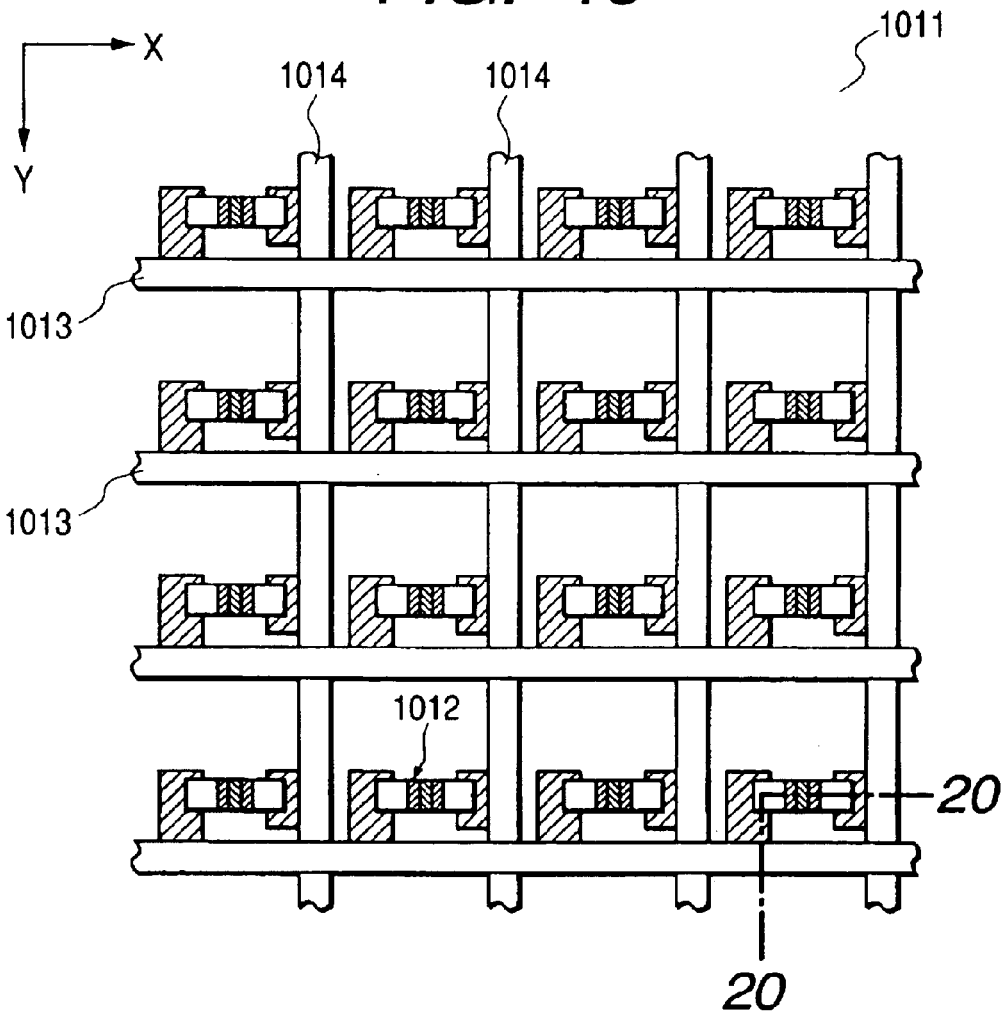
FIG. 19 is a plan view of an example multi-electron beam source that is used for a display panel to which the present invention can be applied.
Figure 24A:
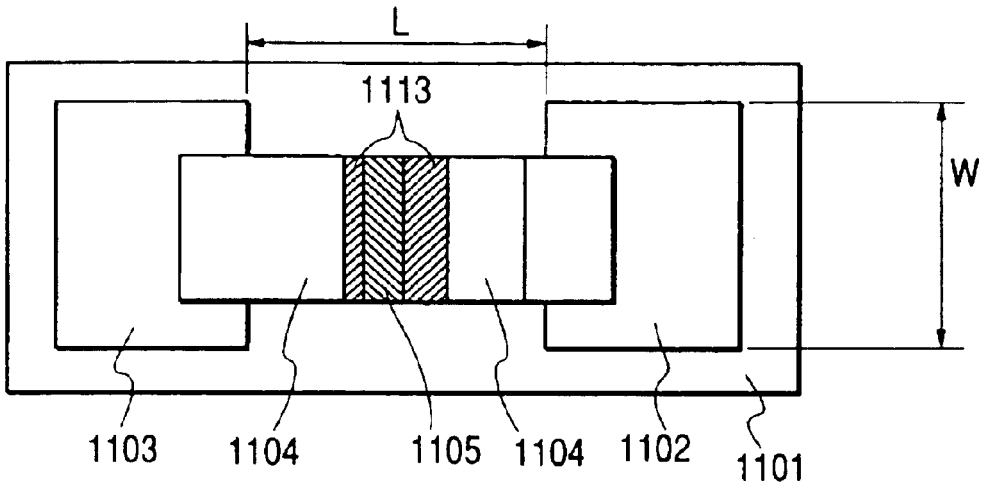
FIGS. 24A and 24B are a specific plan view and a cross-sectional view of a plane type surface conduction electron-emitting device.
Figure 24B:
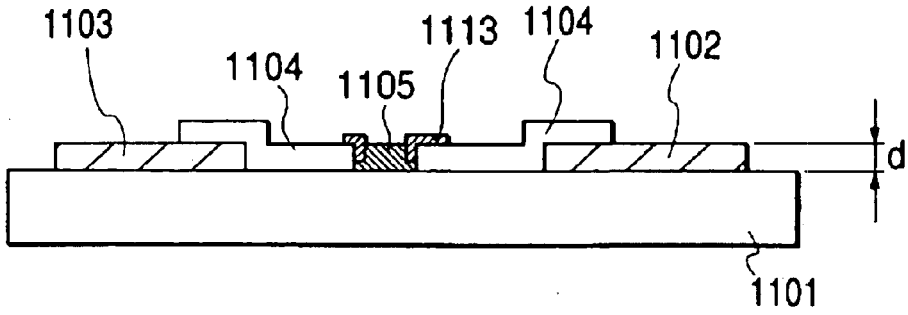

FIG. 19 is a plan view of the multi-electron beam source used for the display panel in FIG. 1. The surface conduction electron-emitting devices, which are shown in FIGS. 24A and 24B and which will be described later, are arranged as cold cathode devices 1012 on the substrate 1011, and these devices are connected in a simple matrix shape by the lines of the row-directional wiring 1013 and the lines of the column-directional wiring 1014. An insulating layer (not shown) is at least formed between the lines at portions where the lines of the row-directional wiring 1013 intersect the lines of the column-directional wiring 1014, so that insulation separates the wiring lines.

Figure 20:
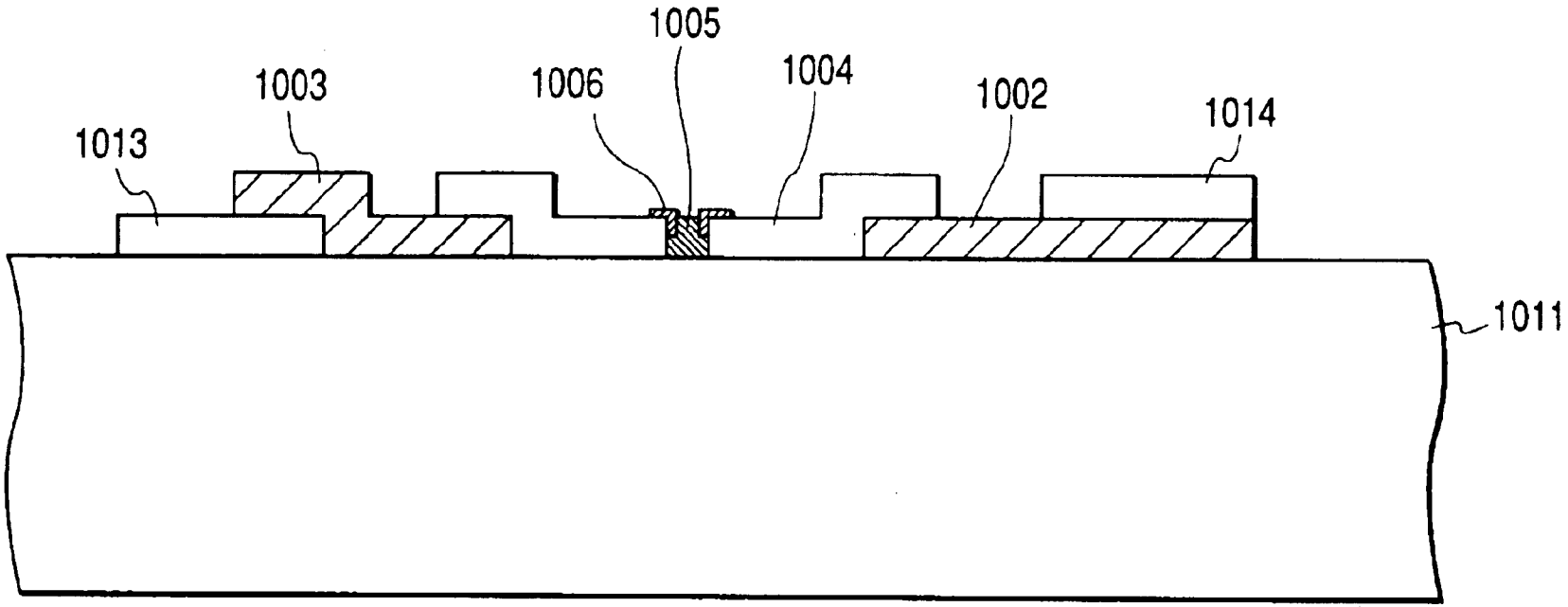
FIG. 20 is a specific cross-sectional view of the multi-electron beam source in FIG. 19 taken along line 20—20.

The cross section taken along line 20—20 in FIG. 19 is shown in FIG. 20. To obtain this multi-electron beam source, the row-directional wiring 1013, the column-directional wiring 1014, the inter-wire insulating layer (not shown), device electrodes 1002 and 1003 of a surface conduction electron-emitting device, and an electroconductive thin film 1004 are formed in advance on the substrate 1011. Then, a current is supplied via the row-directional wiring 1013 and the column-directional wiring 1014 to the device electrodes 1002 and 1003, and the energization forming operation and the energization activation operation, both of which will be described later, are performed. Through the energization forming operation and the energization activation operation, an electron-emitting region 1005 and a thin film 1006, which is composed of a carbon or a carbon compound, are formed.

In this mode, the substrate 1011 of the multi-electron beam source is fixed to the rear plate 1015 of the airtight container. When the substrate 1011 of the multi-electron beam-source is sufficiently strong, the substrate 1011 of the multi-electron beam source may be employed as the rear plate of the airtight container.

Figure 21:
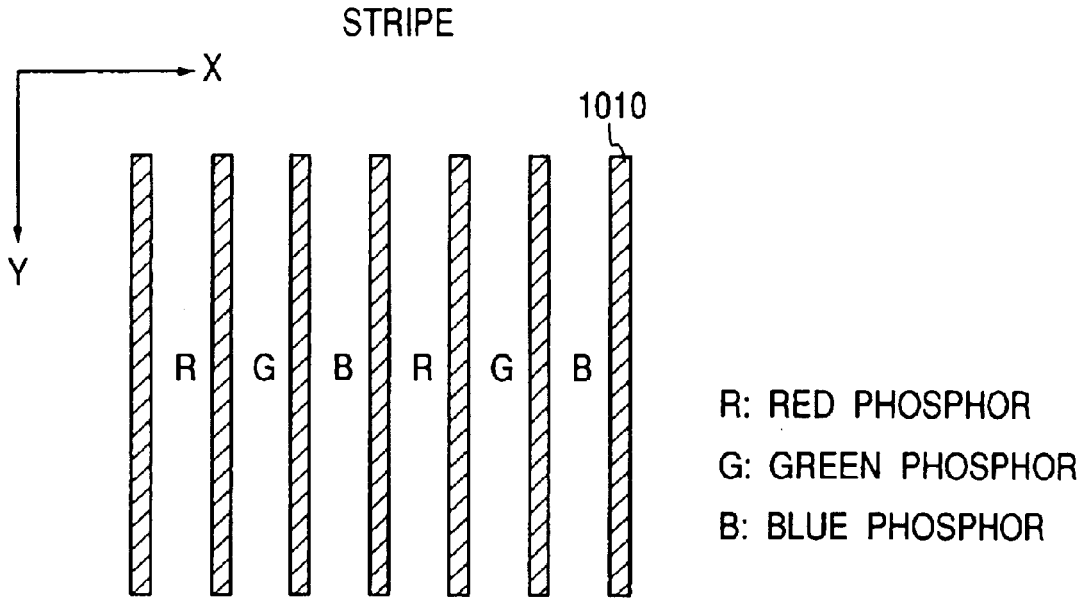
FIG. 21 is a plan view of an example phosphor array (stripe array) on a face plate that is used for the display panel to which the present invention can be applied.

The face plate 1017 serves as a side wall that is located opposite the substrate 1011 of the airtight container, and the phosphor film 1018 is deposited on the lower surface of the face plate 1017. Since a color display panel is provided in this mode, painting of the phosphors of the three primary colors, red, green and blue, which are used for a CRT field, is employed to deposit the phosphor film 1018. The phosphors of the individual colors are used to paint stripes, for example, as is shown in FIG. 21, and a black conductive member 1010 is provided between the stripes of the phosphors. The purposes for which the black conducive member 1010 is provided are: to prevent the shifting of display colors, even when an electron irradiation position is slightly shifted; the prevention of the reflection of external light to avoid the deterioration of display contrast; and to prevent a charge-up of the phosphor film due to electrons. Black lead is employed as the primary element of the black conductive member 1010. However, another material that can appropriately may be used for the above purposes may be employed.

Figure 22:
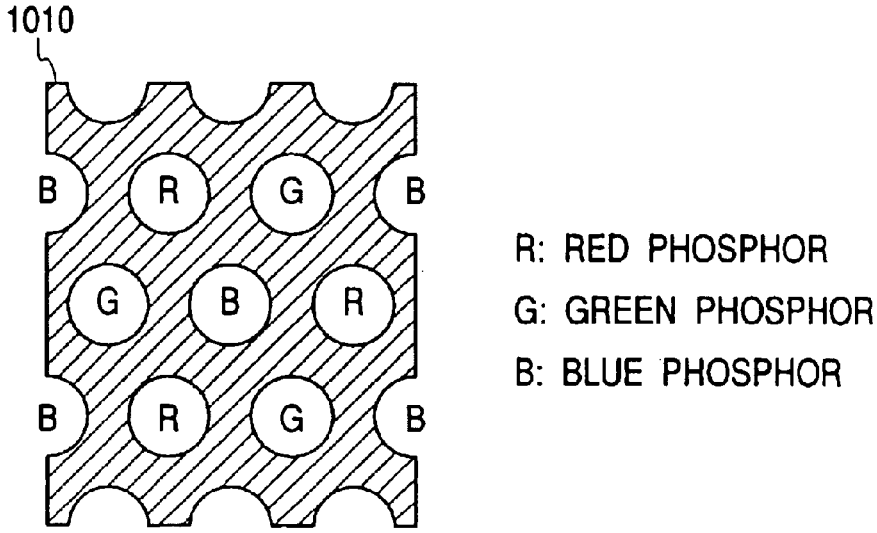
FIG. 22 is a plan view of an example phosphor array (delta array) on the face plate that is used for the display panel to which the present invention can be applied.
Figure 23:
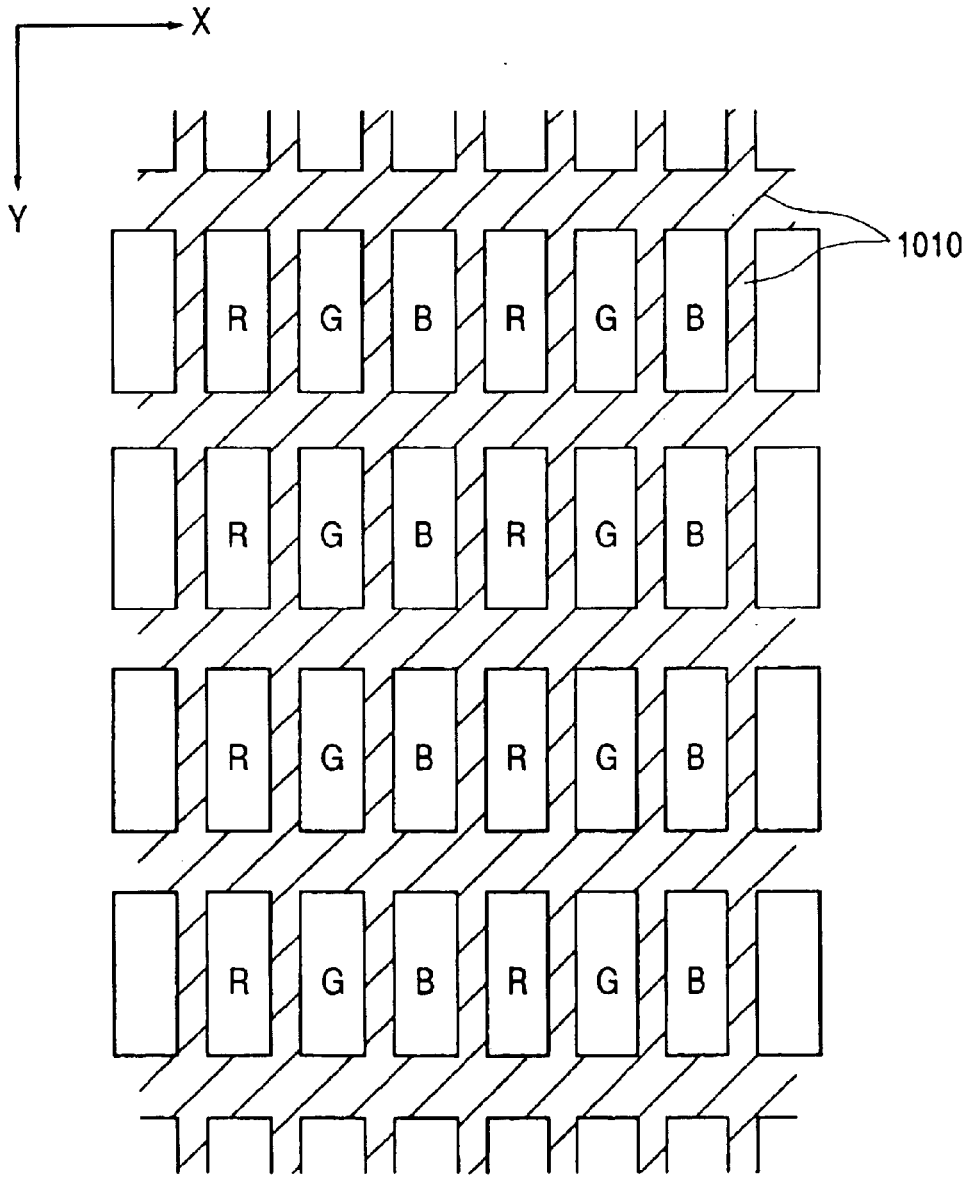
FIG. 23 is a plan view of an example phosphor array (matrix array) on the face plate that is used for the display panel to which the present invention can be applied.

In addition, the array of the phosphors of the three primary colors is not limited to the striped array, and may be a delta array such as is shown in FIG. 22, or a matrix array such as is shown in FIG. 23.

The metal back 1019, which is well known in the CRT field, is provided on the phosphor film 1018, near the rear plate. The purposes for which the metal back 1019 is provided are the improvement of the light employment ratio by a mirror-reflection of one part of the light that is emitted by the phosphor film 1018; the protection of the phosphor film 1018 from collision with negative ions; the employment of the metal back 1019 as an electrode to apply an electron accelerating voltage; and the employment of the phosphor 1018 as a conductive path for excited electrons. To form the metal back 1019, phosphor 1018 is deposited on the face plate 1017 and the surface of the phosphor film is smoothed, and aluminum (Al) is deposited by vacuum evaporation. When a phosphor material used with a low voltage is employed as the phosphor film 1018, the metal back 1019 is not required.

Although not provided for this mode, a transparent electrode made, of, for example, of ITO may be formed between the face plate 1017 and the phosphor film 1018 in order to apply an accelerating voltage and to improve the conductivity of the phosphor film.

The row wiring terminals $D_{x1}$, to $D_{xM}$, the column terminals $D_{y1}$ to $D_{yN}$ and the high voltage terminal Hv are electrical connection terminals provided for the airtight structure in order to electrically connect the display panel to the individual circuits described above. The row wiring terminals $D_{x1}$ to $D_{xM}$ are electrically connected to the row-directional wiring 1013 of the multi-electron beam source; the column wiring terminals $D_{y1}$, to $D_{yN}$ are electrically connected to the column-directional wiring 1014 of the multi-electron beam source; and the high voltage terminal Hv is electrically connected to the metal back 1019 of the face plate 1017.

To discharge air from the airtight container to obtain a vacuum, after the airtight container has been assembled, an exhaust pipe (not show) is connected to a vacuum pump and air is discharged from the airtight container until a degree of vacuum of 1.3×10-4 [Pa] (10-7 [Torr]) is reached. Thereafter, the exhaust pipe is closed. In order to maintain the degree of vacuum in the airtight container, a getter film (not shown) is deposited at a predetermined position in the airtight container immediately before or after the exhaust pipe is closed. The getter film is deposited when, for example, a getter material that contains Ba as its primary element is heated and evaporated using a heater or by high-frequency heating. Because of the absorption function of the getter film, the airtight container is maintained at a degree of vacuum of 1.3×10-2 to 1.3×10-4 [Pa] (1×1-5 to 1×10-7 [torr]).

The spacer 1020 will now be described while referring to FIG. 2.

For the spacer 1020, the high resistance film 1022 is deposited on the surface of the insulating base member 21 to prevent charging, and the low resistance film 25 is deposited on the internal face (metal back 1017) of the face plate 1017, on the contact face 23 that contacts the surface (the row-directional wiring 1013 or the column-directional wiring 1014) of the substrate 1011, and on the side face 24 that is adjacent to the contact face 23. The number of low resistance films 25 that is required to achieve the objectives are located at a required interval, and contact the inside of the face plate 1017 and the surface of the substrate 1011. The high resistance film 22 is at least deposited on the surface of the insulating base member 21 that is exposed in the vacuum airtight container. The high resistance film 22 is electrically connected, via the low resistant films 25 of the spacer 1020, to the inside (metal back 1019, etc.) of the face plate 1017 and to the surface of the substrate 1011.

The spacer 1020 must provide sufficient insulation to resist a high voltage that is applied between the row-directional wiring 1013 and the column-directional wiring 1014 of the substrate 1011, and the metal back 1019 inside the face plate 1017. Further, the spacer 1020 must be sufficiently electroconductive to prevent the charging of the surface of the spacer 1020.

The insulating base member 21 of the spacer 1020 can, for example, be silica glass; glass having a reduced content of an impurity, such as Na; soda lime glass; or a ceramics material such as alumina. It is preferable that the insulating base member 21 have a thermal expansion ratio near that of a material used for the airtight container and the substrate 1011.

In the spacer 1020, an accelerating voltage Va to be applied to the face plate 1017 (the metal back 1019, etc.) at a high potential is divided by resistance Rs of the high resistant film 22, which is a charging prevention film, and the obtained current is supplied to the high resistance film 22. Therefore, the resistance Rs of the spacer 1020 is set in a desired range because of the need for charging prevention and in accordance with the power consumption. From the viewpoint of preventing charging, the sheet resistance of the surface is preferably equal to or less than 1014 [Ω/□]. More preferably, a sheet resistance is employed that is equal to or less than 1013 [Ω/□] in order to obtain satisfactory charging prevention effects. While the lower limit of the surface resistance is varied depending on the shape of the spacer 1020 and the voltage applied to the spacer 1020, it is preferably equal to or less than 107 [Ω/□].

It is preferable that the film thickness t of the charging prevention film, which is deposited on the insulating base member 21, fall within a range of 10 nm to 1 μm. The film thickness is varied depending on the surface energy of the material used for the insulating base member 21, the adhesion to the substrate 1011 and the temperature of the substrate 1011; however, generally, a thin film having a thickness of less than 10 nm is formed in an island shape, and has an unstable resistance and poor reproductivity. Whereas, if the film thickness exceeds 1 μm, the stress imposed of the film is increased, and the film tends to peel off. In addition, the time required for film deposition is extended, and productivity is deteriorated.

Therefore, the thickness of the charging prevention film is preferably 50 to 500 nm. The surface resistance is ρ/t, and in accordance with the desired range of the surface resistance and the film thickness t described above, it is preferable that the resistivity ρ of the charging prevention film be 10 to 1010 [Ω·cm]. Further, in order to obtain a more desirable range for the surface resistance and the film thickness t, the resistivity p should be 104 to 108 [Ω·cm].

As is described above, when a current flows across the charging prevention film that is deposited on the spacer

1020, or when the entire display panel is heated during the operation, the temperature of the spacer 1020 is increased. If the resistant temperature coefficient of the charging prevention film is a large negative value, the resistance is reduced when the temperature is raised, and a current flowing across the spacer 1020 is increased, which causes a further temperature rise. The current is continuously increased until it exceeds the limit of the power source. The resistant temperature coefficient whereat exclusion of the current occurs is an empiric negative value whose absolute value is 1% or greater. In other words, it is preferable that the resistant temperature coefficient of the charging prevention film be less than −1%.

A metal oxide, for example, may be employed as the high resistance film 22 that has such a charging prevention characteristic. Among the metal oxides, chrome oxide, nickel oxide and copper oxide are preferable. This is because these oxide materials have a comparatively small secondary electron emission efficiency, and are difficult to charged even when electrons emitted by the cold cathode devices 1012 (see FIG. 1) strike the spacer 1020. Other than the metal oxides, carbon is also preferable because it has a small secondary electron emission efficiency. Especially, since amorphous carbon has a high resistance, the resistance of the spacer 1020 is easily adjusted to a desired value. A preferable value for the secondary electron emission coefficient is equal to or smaller than 3.5, and more preferably, is equal to or smaller than 2.

Another material used for the high resistance film 22 that has a charging prevention characteristic is nitride of aluminum with a shift metal alloy. This material is preferable because, when the composition of a shift metal is adjusted, the resistance can be adjusted for a variety of materials ranging from a conductive material to an insulating material. Further, the resistance of this material is changes less and remains stable during the display panel manufacturing process that will be described later. In addition, this material has a resistant temperature coefficient of less than −1%, and practically is very easy to handle. The shift metal elements are Ti, Cr, Ta, etc.

The alloy nitride film is deposited on the insulating base member by thin film deposition means, such as reactive sputtering in a nitrogen gas atmosphere, electron beam evaporation, ion plating, or ion assist evaporation. The metal oxide film can be deposited using the same thin film deposition method and by using oxide gas instead of the nitrogen gas. The metal oxide film can also be formed by the CVD method or the alkoxide coating method. The carbon film is deposited by evaporation, sputtering, the CVD method, or the plasma CVD method. Especially when depositing an amorphous carbon film, hydrogen should be included in the film deposition atmosphere, or carbonated hydrogen gas should be used as the film deposition gas.

The low resistant film 25 that constitutes the spacer 1020 is provided to electrically connect the high resistance film 22 to the high-potential face plate 1017 (the metal back 1019, etc.) and the low-potential substrate 1011 (the row-directional wiring 1013, the column-directional wiring 1014, etc.). The low resistance film 22 includes a plurality of functions listed below.

(1) Electrical connection of the high resistance film 22 to the face plate 1017 and the substrate 1011

As previously described, the high resistance film 22 is formed in order to prevent the charging of the surface of the spacer 1020. When the high resistance film 22 is connected to the face plate 1017 (the metal back 1019, etc.) and the substrate 1011 (the row-directional wiring 1013, the column-directional wiring 1014, etc.), a large contact resistance may build up across the surface of the joint, and quick elimination of a charge that is generated on the surface of the spacer 1020 will not be possible. Therefore, a low resistance intermediate layer (the low resistance film 25) is formed on the contact face 23 or the side face 24 of the spacer 1020 that abuts upon the substrate 1011, so that the charge that is generated on the surface of the spacer 1020 can be quickly removed.

(2) Uniform distribution of the potential of the high resistance film 22

An electron emitted by the cold cathode device 1012 forms its trajectory in accordance with the potential distribution defined between the face plate 1017 and the substrate 1011. In order to prevent the electron trajectory from being distorted in the vicinity of the spacer 1020, the overall distribution of the potential of the high resistant film 22 must be controlled. When the high resistance film 22 is connected to the face plate 1017 (the metal back 1019, etc.) and the substrate 1011 (the row-directional wiring 1013, the column-directional wiring 1014, etc.), the connected state is varied because of the contact resistance on the surface at the joint, and the potential distribution of the high resistance film 22 may be shifted away from a desired value. Therefore, a low resistance intermediate layer is formed that covers all the longitudinal region of the spacer end (the contact face 23 or the side face 24) whereat the spacer 1020 contacts the face plate 1017 and the substrate 1011. When a desired potential is applied to the intermediate layer, the full potential of the high resistance film 22 can be controlled.

(3) Control of the trajectory of an emitted electron

An electron emitted by the cold cathode device forms its trajectory in accordance with the potential distribution that is defined between the face plate 1017 and the substrate 1011. As for an electron emitted by the cold cathode device 1012 near the spacer 1020, restriction (a change of wiring and device positions, etc.) may be required that is accompanied by the installation of the spacer 1020. In this case, to form an image that is not wavy and distorted, the trajectory of an emitted electron must be controlled so that the emitted electron travels to a desired position on the face plate 1017. Since the low resistance intermediate layer is formed on the side faces 24 that contact the face plate 1017 and the substrate 1011, a desirable characteristic can be provided for the potential distribution near the spacer 1020, and the trajectory of an emitted electron can be controlled.

For the low resistance film 25, a material need only be selected that has a considerably lower resistance than the high resistance film 22. The material is selected as needed from among: a print conductive member that is formed of metal or an alloy of Ni, Cr, Au, Mo, W, Pt, Ti, Al, Cu, Pd, etc., and glass; a conductive particle dispersing film, in which conductive particles obtained by doping SnO2 particles with Sb are dispersed in a binder obtained by replacing the terminal of silica or silicon oxide with alkyl, alkoxy or fluorine; or a semiconductor material, such as a transparent conductive material like $In_2$-$O_3$ or polysilicon.

In the image display apparatus using the above descried display panel, when a voltage is applied to the individual cold cathode devices 1012 via the row wiring terminals $D_{x1}$ to $D_{xM}$ and the column wiring terminals $D_{y1}$ to $D_{yN}$, an electron is emitted from the cold cathode device 1012. At the same time, a high voltage of several hundred [Vs] or several [KVs] is applied to the metal back 1019 via the high-voltage terminal Hv, and the emitted electrons are accelerated toward the face plate 1017 and strike the internal face of the face plate 1017. As a result, the individual color phosphors of the phosphor film 1018 are excited and emit light, so that an image is displayed.

Generally, when the surface conduction electron-emitting device is employed as the cold cathode device 1012, the voltage applied to the cold cathode device 1012 is about 12 to 16 [V]; the distance d between the metal back 1019 and the cold cathode device 1012 is 0.1 to 8 [mm]; and the voltage applied between the metal back 1019 and the cold cathode device 1012 is 1 to 10 [kVs].

Since not only the low resistance film 25 but also the high resistance film 22 are formed for the spacer 1020, the charging on the spacer surface is prevented, and, accordingly, a preferable image having no shifting of light emitting points can be obtained. More preferably, as previously mentioned, since the high resistance film has a sheet resistance of $10^7$ to $10^{14}$ [Ω/□], the charging, and the power consumption and heat generation between the upper and lower substrates can be suppressed. Further, the sheet resistance of the low resistance film 25 is 1/10, or even less, the sheet resistance of the high resistance film 22 because preferable electrical bonding of the upper and lower substrates is obtained. In addition, it is preferable that the electron-emitting device be a cold cathode device, have a conductive film that includes an electron-emitting region between the electrodes, and be a surface conduction electron-emitting device, because the structure of the device can be simplified and a high luminance value can be obtained.

(Method for manufacturing a multi-electron beam source)

A method for manufacturing a multi-electron beam source will now be explained. For a multi-electron beam source used for the electron beam apparatus of this invention there are no limitations placed on the material, or on the shape or the fabrication method used for a cold cathode device. Therefore, a surface conduction electron-emitting device, or an FE or MIM cold cathode device can be employed.

Since a method for manufacturing a surface conduction electron-emitting device is comparatively simple, it is easy to increase the size or to reduce the manufacturing costs. The present inventor found that a surface conductive electron-emitting device for which an electron-emitting region or its periphery is formed of a particle film has an especially superior electron emission characteristic, and is easily manufactured. Therefore, such a surface conduction electron-emitting device seems to be optimal for the multi-electron beam source for a high-luminance, large-screen image display apparatus. Therefore, for the display panel in the above mode, there is employed a surface conduction electron-emitting device for which the electron-emitting region or its periphery is formed of a particle film. First, an explanation will be given for the basic arrangement, the manufacturing method and the characteristic that are preferred for a surface conduction electron-emitting device, and then an explanation will be given for the structure of the multi-electron beam source whereat multiple devices are arranged by using simple matrix wiring.

[Preferred device structure and manufacturing method for surface conduction electron-emitting device]

There are two types of typical structures, a plane type and a step type, for surface conduction electron-emitting devices for which an electron-emitting region or its periphery is formed of a particle film. In the following explanation, a plane type surface conduction electron-emitting device is employed.

FIGS. 24A and 24B are a plan view and a cross-sectional view for explaining the arrangement of the plane type surface conduction electron-emitting device. In the drawings, reference numeral 1101 denotes a substrate; 1102 and 1103, device electrodes; 1104, an electroconductive thin film; 1105, an electron-emitting region formed by the energization forming operation; and 1113, a thin film deposited by the energization activation operation.

The substrate 1011 can be one of various types of glass substrates, such as silica glass and soda lime glass, or of various types of ceramics substrates, such as alumina, or can be a substrate obtained by laminating, for example, an insulating layer made of $SiO_2$ on the above described substrates.

The device electrodes 1102 and 1103, which are formed on the substrate 1101 so they are parallel to the substrate face and are opposite each other, are made of a conductive material. The material is selected as needed from among metals, such as Ni, Cr, Au, Mo, W, Pt, Ti, Cu, Pd or Ag, or a metal alloy; a metal oxide, such as $In_2$-$O_2$; and a semiconductor material, such as polysilicon. The device electrode 1102 and 1103 can be easily formed by both a film deposition technique, such as vacuum evaporation, and a patterning technique, such as photolithography or etching. However, another method (e.g., a printing technique) may be employed.

The shapes of the device electrode 1102 and 1103 are designed as needed in accordance with the purpose of the electron-emitting device. Generally, as the electrode interval L, an appropriate numerical value is selected from several hundred As to several hundred μms, and preferably from several to several tens of μms in order to be used for a display panel. As the thickness d for the device electrodes 1102 and 1103, generally an appropriate numerical value is selected from several hundred As to several μms.

A particle film is employed as the electroconductive thin film 1104. A particle film is a film (including an island-shaped film set) that contains multiple particles as elements. To examine a particle film microscopically, normally, the structure wherein the individual particles are separately located, the structure wherein the particles are adjacent each other, or the structure wherein the particles overlap each other is viewed.

As is described above, a particle film is employed as the electroconductive thin film 1104, and the sheet resistance is set so it ranges from $10^3$ to $10^7$ [Ω/□].

The electron-emitting region 1105 is a fissure portion that is partially formed in the electroconductive thin film 1104, and has a higher resistance than the electroconductive film 1104 on the periphery. This fissure is formed when the energization forming operation, which will be described later, is performed for the electroconductive thin film 1104. Particles having a diameter of several to several hundred of Âs may be placed in the fissure. Since it is difficult to illustrate the precise and accurate shape and position of the actual electron-emitting region 1105, the region is specifically shown in FIGS. 24A and 24B.

The thin film 1113 is made of carbon or a carbon compound, and covers the electron-emitting region 1105 and its vicinity. After the energization forming operation, the thin film 1113 is deposited by performing the energization activation operation, which will be described later.

The basic structure of the preferred cold cathode device has been explained, and the following device is employed for this mode.

Specifically, soda lime glass is employed for the substrate 1101, and an Ni thin film is employed as the device electrode 1102 and 1103. The thickness d of the device electrodes 1102 and 1103 is defined as 1000 Å, and the electrode interval L is defined as 2 μm.

A method for manufacturing the preferred plane type surface conduction electron-emitting device will now be described.

FIGS. 25A to 25E are cross-sectional views for explaining the processing for manufacturing a surface conduction electron-emitting device. The same reference numbers as in FIGS. 24A and 24B are used for the individual portions.

Figure 25A:
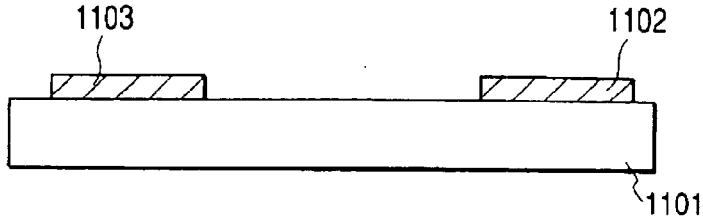
FIGS. 25A, 25B, 25C, 25D and 25E are cross-sectional views for explaining the processing for fabricating the surface conduction electron-emitting device shown in FIGS. 24A and 24B.

(1) First, as is shown in FIG. 25A, the device electrodes 1102 and 1103 are formed on the substrate 1101. For this formation, the substrate 1101 is washed well using a cleanser, pure water and an organic solvent, and the material for the device electrodes 1102 and 1103 are deposited thereon (a vacuum film deposition technique, such as the evaporation method or the sputtering method, may be used as the deposition method). The deposited electrode material is patterned using the lithographic etching technique, so that a pair of device electrodes 1102 and 1103 are formed.

Figure 25B:
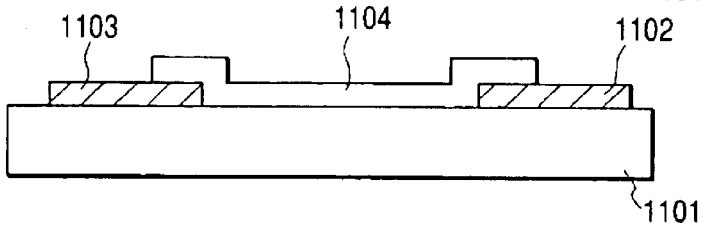

(2) Then, as is shown in FIG. 25B, the electroconductive thin film 1104 is formed. For this formation, first, a coating comprising an organic metal solution is applied to the substrate 1101, whereon the device electrodes 1102 and 1103 are formed, and dried, and a particle film, deposited by annealing the resultant structure, is patterned and given a predetermined shape by employing photolighographic etching. The organic metal solution is a solution prepared using an organic metal compound that contains, as a primary element, the particle material used for the electroconductive thin film 1104. (Specifically, Pd is employed as the primary element in this mode. Further, a dipping method is employed as a coating method for this mode. However, another method, such as a spinner method or a spray method, may be employed.)

To deposit the electroconductive thin film 1104, which is a particle film, not only the organic metal solution coating method used for this mode, but also a vacuum evaporation method, a sputtering method, or a chemical vapor deposition method may be employed.

Figure 25C:
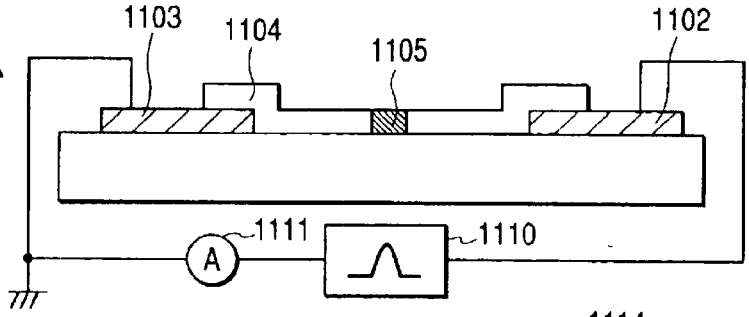

(3) Following this, as is shown in FIG. 25C, an appropriate voltage from a forming power source 1110 is applied to the device electrodes 1102 and 1103, and the energization forming operation is performed. As a result, the electron-emitting region 1105 is formed in the electroconductive thin film 1104.

The energization forming operation is an operation for energizing the electroconductive thin film 1104 made of a particle film to appropriately destroy, deform or degenerate, to obtain a structure appropriate for electron emission. An appropriate fissure is formed in the portion (i.e., the electron-emitting region 1105), of the thin film 1104 made of the particle film, that is changed to a preferred structure for electron emission. When the electron-emitting region 1105 is formed, the electric resistance measured between the device electrodes 1102 and 1103 is greatly increased, compared with what it was before the region 1105 was formed.

Figure 25D:
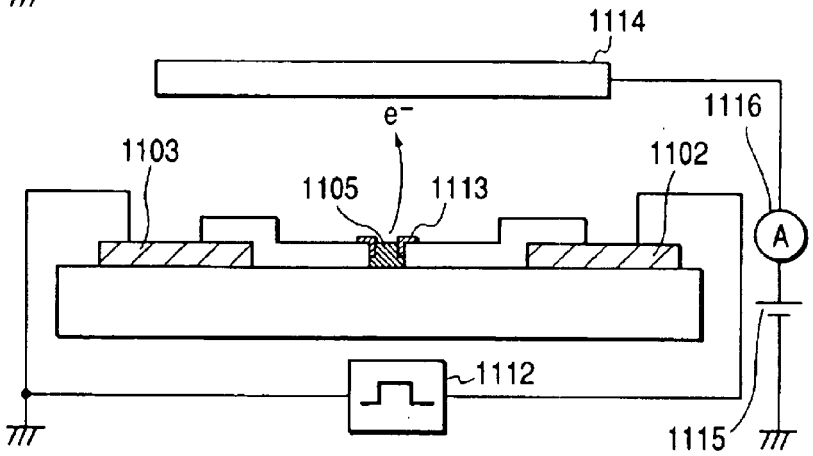

(4) Next, as is shown in FIG. 25D, a voltage from an activation power source 1112 is applied as needed to the device electrodes 1102 and 1103, and the energization activation operation is performed to improve the electron emission characteristic. In the energization activation operation, a current is supplied to the electron-emitting region 1105 that is formed in the energization forming operation, and carbon or a carbon compound is deposited in the vicinity. (In FIG. 25D, the carbon or the carbon compound that is deposited is specifically shown as the thin film 1113.) When the energization activation operation is performed, specifically, the current emitted upon the application of the same voltage can be increased 100 times or more, compared with the situation that existed before the operation was performed.

Reference numeral 1114 in FIG. 24D denotes an anode electrode for acquiring emission current Ie that is supplied by the surface conduction electron-emitting device. A direct-current high voltage power source 1115 and a current meter 1116 are connected to the anode electrode 1114. When the activation operation is to be performed after the substrate 1101 has been assembled inside the display panel, the phosphorous face of the display panel is used as the anode electrode 1114. During the application of a voltage from the activation power source 1112, the current meter 1116 measures the emission current Ie to monitor the state of the energization activation process and to control the operation of the activation power source 1112.

Figure 25E:
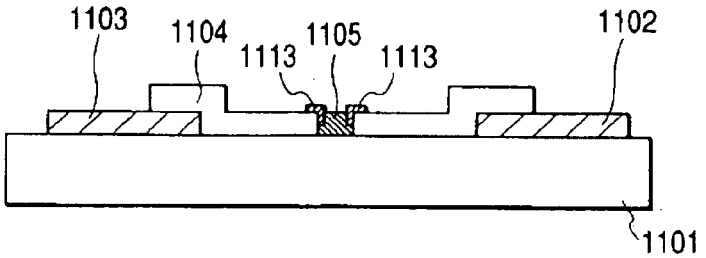

The plane type surface conduction electron-emitting device shown in FIG. 25E is thus obtained.

(Characteristic of a surface conduction electron-emitting device used for a display panel)

The structure and the manufacturing method for the plane type surface conduction electron-emitting device have been explained. The characteristic of the device used for a display panel will now be described.

Figure 26:
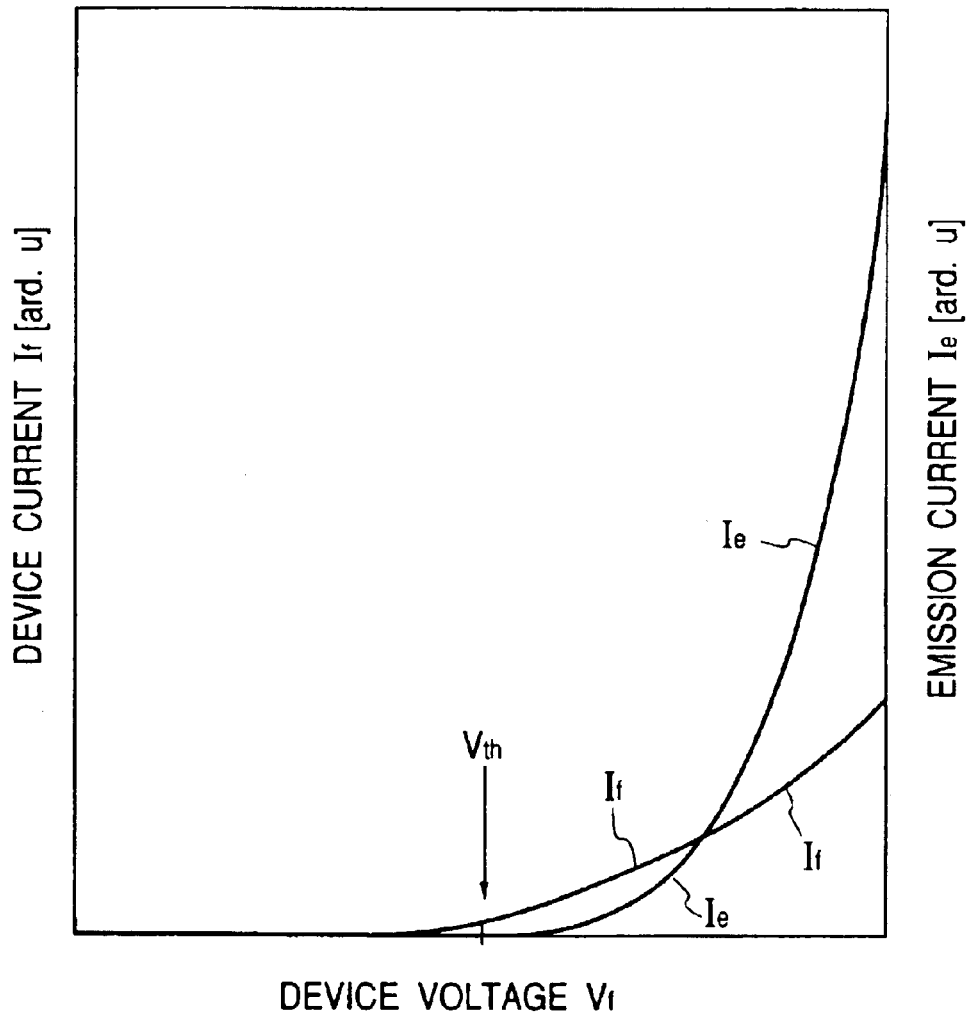
FIG. 26 is a graph showing the typical characteristics of the surface conduction electron-emitting device.

FIG. 26 is a diagram showing a typical example for the surface conduction electron-emitting device used for the display panel of this mode, for the relationship between the emission current Ie and the applied device voltage Vf and for the relationship between the device current If and the applied device voltage Vf. Since the emission current Ie is considerably smaller than the device current If and can not be described using the same scale, and since the characteristics are changed as the design parameters, such as the size and the shape of the device, are altered, two graphs are shown that use arbitrary units.

Relative to the emission current Ie, the surface conduction electron-emitting device used for the display panel has the following three characteristics.

First, when a voltage equal to or higher than a specific voltage (threshold voltage Vth) is applied to the device, the emission current Ie is drastically increased. When a voltage lower than the threshold voltage Vth is applied, almost no emission current Ie can be detected. That is, a non-linear device is obtained that, for the emission current Ie, has an obvious threshold voltage Vth.

Second, since the emission current Ie is changed depending on the voltage Vf that is applied to the device, the level of the emission current Ie can be controlled by using the voltage Vf.

Third, since the response of the current Ie emitted by the device is quick, upon the application of the voltage Vf to the device, the number of charges emitted by the device can be controlled in accordance with the period of time the voltage Vf is applied.

Since the plane type surface conduction electron-emitting device in this mode includes the above described characteristics, this device can be preferably employed for a display panel. When, for example, the first characteristic is employed for a display panel whereon multiple devices are arranged in consonance with the pixels on the display screen, the display screen can be scanned sequentially. That is, in accordance with a desired luminance level, a voltage equal to or higher than the threshold voltage Vth is applied to a device that is driven, and a voltage power lower than the threshold voltage Vth is applied to a device that is not selected. When the device to be driven is changed sequentially, the display screen can be scanned sequentially to display an image.

Furthermore, when the second or the third characteristic is employed, the luminance level can be controlled, so that a gray scale display can be provided.

The structure of a multi-electron source, for which surface conduction electron-emitting devices are arranged on the substrate and simple matrix wiring is provided, is as shown in FIGS. 19 and 20, which were described above.

An explanation will now be given, while referring to FIG. 27, for the arrangement of an image display apparatus that includes a display panel whereon the surface conduction electron-emitting devices are arranged.

Figure 27:
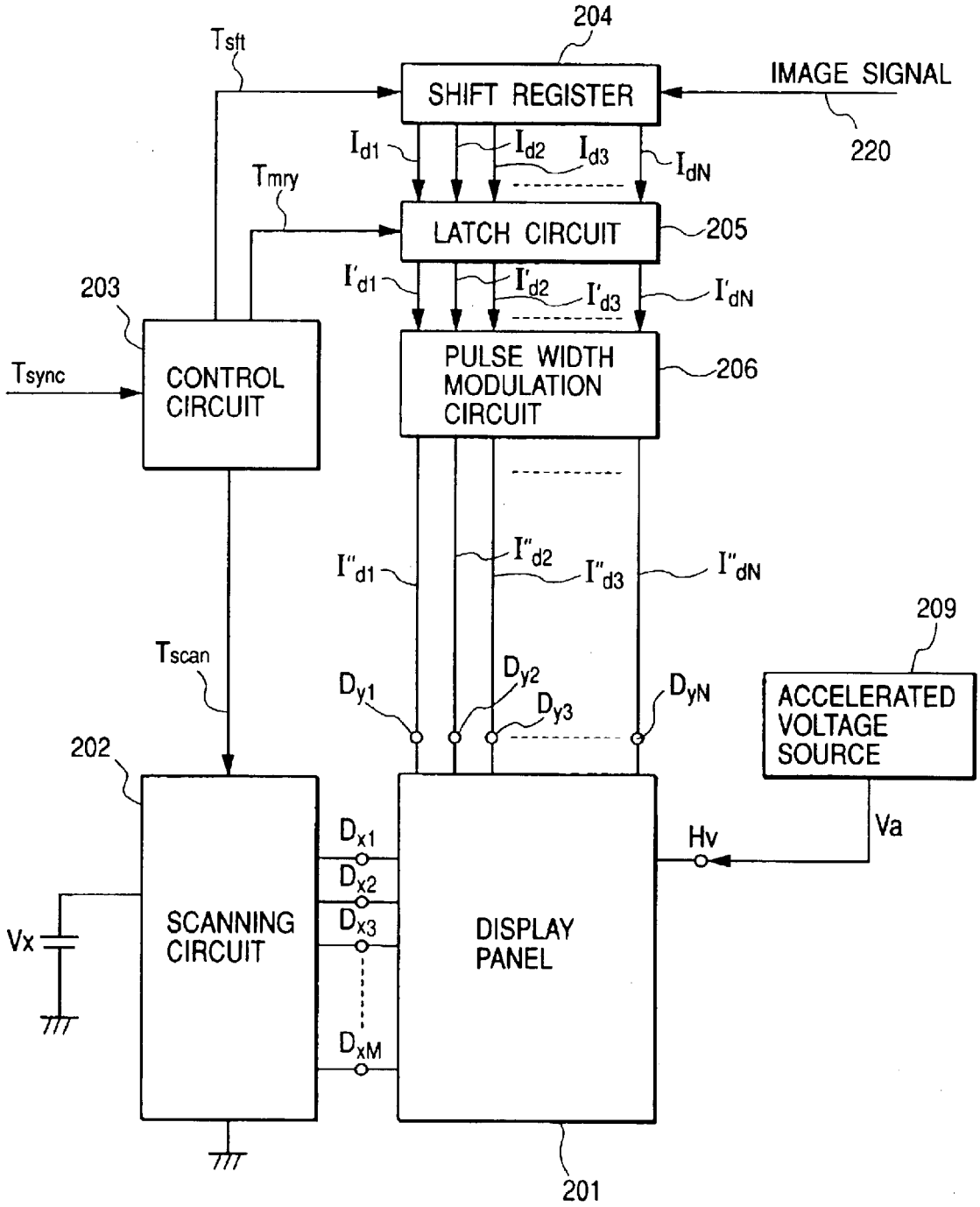
FIG. 27 is a block diagram illustrating the schematic arrangement of a drive circuit in an image display apparatus.

In FIG. 27, a display panel 201 is connected to an external drive circuit via the row wiring terminals $D_{x1}$ to $D_{xM}$, which are connected to row-directional wiring in the display panel 201, and the column wiring terminals $D_{y1}$ to $D_{yN}$, which are connected to the column directional wiring in the display panel 201. A scan signal is transmitted by a scanning circuit 202 to the row wiring terminals $D_{x1}$ to $D_{xM}$ in order to select and drive each row in the multi-electron source in the display panel 201, i.e., each row of surface conduction electron-emitting devices that are arrayed in a matrix of M rows and N columns. A modulation signal is applied to the column wiring terminals $D_{y1}$ to $D_{yN}$, so that electrons that are emitted by the surface conduction electron-emitting devices in the selected row are controlled in accordance with a received video signal.

A control circuit 203 functions as a device for matching operating timings of the individual sections, so as to provide an appropriate display in accordance with an externally input video signal. An externally input video signal 220 may be a signal, such as an NTSC signal, whereby image data and a synchronization signal are synthesized, or a signal whereby they are separated. In this mode, the second signal is employed for the explanation. For the first video signal, a well known synchronization separation circuit is provided to separate image data from a synchronization signal Tsync, and while the image data are transmitted to a shift register 204, the synchronization signal is transmitted to the control circuit 203. Then, the signal can be processed in the same manner as in this mode.

Based on the externally input synchronization signal Tsync, the control circuit 203 generates control signals, such as a horizontal synchronization signal Tscan, a latch signal Tmry and a shift signal Tsft, for the individual sections.

The image data (luminance data) included in the externally input video signal are transmitted to the shift register 204. The shift register performs serial/parallel conversion for each line of serial image data that are received in the time series. The shift register 204 is synchronized with the control signal (shift signal) Tsft that is received from the control circuit 203, and receives and maintains the serial image data. The converted image data for one line that corresponds to data for driving N electron-emitting devices) are transmitted as parallel signals $I_{d1}$ to $I_{dN}$ to a latch circuit 205 by the shift register 204.

The latch circuit 25 is a storage circuit for storing the image data for one line for a required period of time. In accordance with a control signal Tmmy received from the control circuit 203, the latch circuit 205 stores the parallel signals $I_{d1}$ to $I_{dN}$. The image data stored in the latch circuit 205 are output as parallel signals $I'_{d1}$ to $I'_{dN}$ to a pulse width modulation circuit 206. The pulse width modulation circuit 206 modulates pulse widths in accordance with the image data ($I'_{d1}$ to $I'd_M$), and outputs the obtained voltage signals $I''_{d1}$ to $I''_{dN}$ at a constant amplitude (voltage value), in accordance with the parallel signals $I'_{d1}$ to $I'_{dM}$ More specifically, as the luminance level of the image data moves higher, the pulse width modulation circuit 206 outputs a wider voltage pulse. For example, a voltage pulse of 30 $\mu$ second for the maximum luminance, or 0.12 u second for the minimum luminance, is output at an amplitude of 7.5 [V]. The output signals $I''_{d1}$ to $I''_{dN}$ are transmitted to the column wiring terminals $D_{y1}$ to $D_{yN}$ of the display panel 201.

A direct-current voltage Va of, for example, 5 KV is transmitted by an accelerated voltage source 209 to the high-voltage terminal Hv of the display panel 201.

The scanning circuit 202 will now be described. The circuit 202 includes M switching devices, which select either a voltage output by the direct-current voltage source Vx or 0 [V] (ground level), and which are electrically connected to the terminals $D_{x1}$ to $D_{xM}$ of the display panel 201. The switching device change is performed based on the control signal Tscan output by the control circuit 203. Actually, a switching device change is easily carried out when, for example, an assembly of switching devices, such as FETs, is actually employed. The direct-current voltage source Vx is set to output a constant voltage, so that, based on the characteristic of the electron-emitting device shown in FIG. 26, the drive voltage to be applied to a device that is not being driven is equal to or lower than the electron emission threshold voltage Vth. The controller 203 matches the individual operations so as to provide an appropriate display based on an externally input image signal.

Either a digital signal type or an analog signal type can be employed for the shift register 204 and the line memory 205. This is because the serial/parallel conversion and storage of an image signal need only be performed at a predetermined speed.

In the thus arranged image display apparatus in this mode, electrons are emitted when a voltage is applied to the electron-emitting devices via external container terminals $D_{x1}$ to $D_{xM}$ and $D_{y1}$ to $D_{yN}$. Further, a high voltage is applied via the high-voltage terminal Hv to the metal back 1019 (see FIG. 1) or a transparent electrode (not shown), and an electron beam is accelerated. The accelerated electron strikes the phosphor film 1018 (see FIG. 1), and light emission occurs and forms an image.

The above described arrangement of the image display apparatus is merely an example of an image-forming apparatus to which the present invention can be applied, and can be variously modified based on the idea of the present invention. An NTSC signal is employed as an input signal, but the input signal is not limited to this, and it can be a PAL signal, a SECAM signal, or a TV signal (high-quality TV signal, such as a MUSE signal) consisting of more scan lines than these signals.

(Case of ladder-like electron beam source)

An explanation will now be given, while referring to FIGS. 28 and 29, for the previously mentioned ladder-like electron source substrate and an image display apparatus that uses this substrate.

Figure 28:
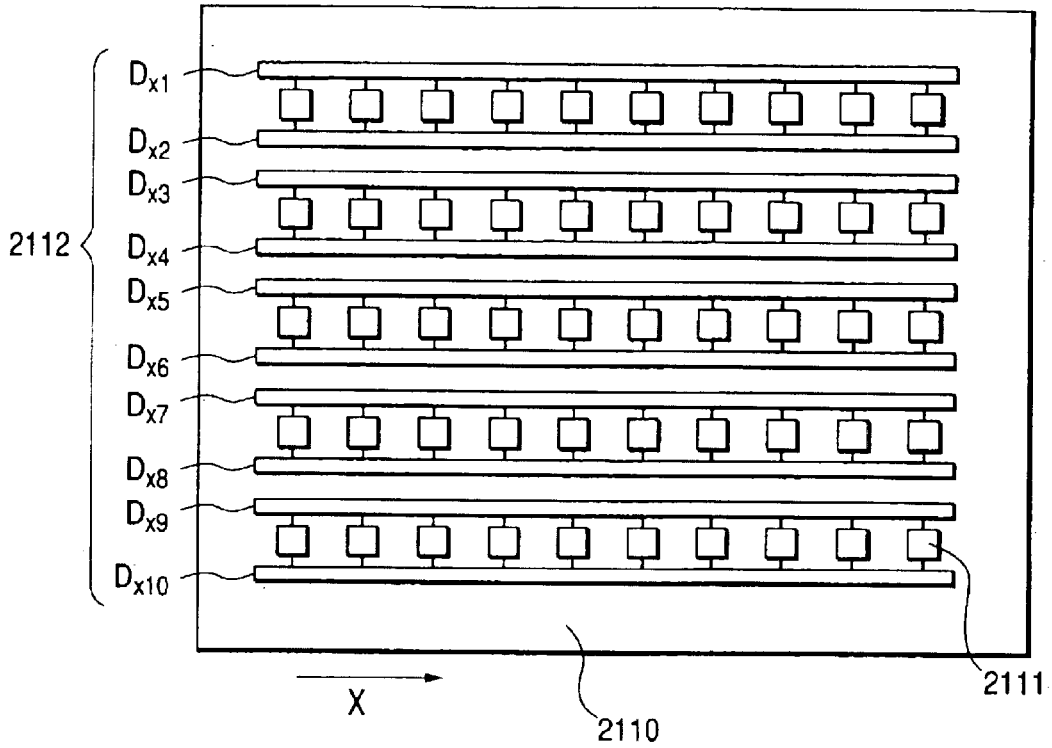
FIG. 28 is a specific plan view of a ladder-like array electron source.
Figure 30:
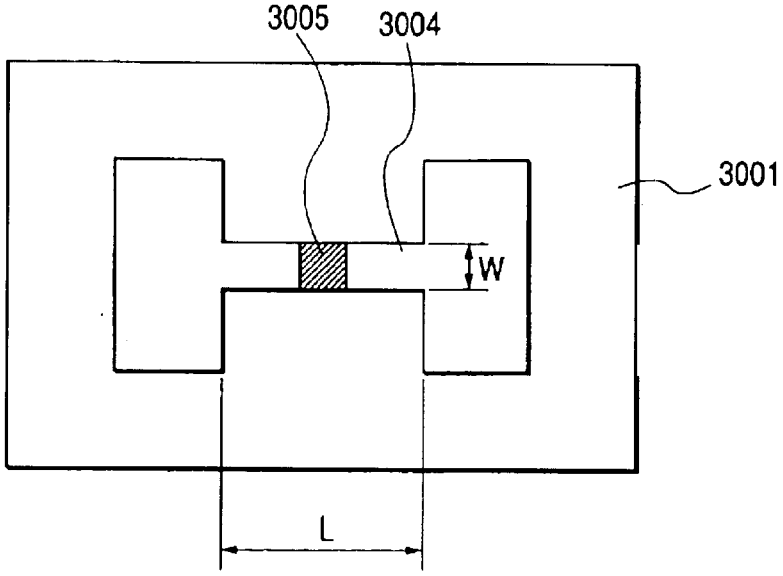
FIG. 30 is a plan view of a conventional typical surface conduction electron-emitting device.

In FIG. 28, reference numeral 2110 denotes an electron source substrate; 2111, electron-emitting devices; and 2112, common wiring lines $D_{x1}$ to $D_{x10}$ that are connected to the electron-emitting devices 2112. The electron-emitting devices 2111 are arranged on the substrate 2110 in parallel in the X direction (these are called device rows). A plurality of device rows are located on the substrate 2110 to form a ladder-like electron source substrate. When a drive voltage is applied as needed to the common wiring between the individual device rows, each device row can be independently driven. That is, a voltage equal to or higher than the electron emission threshold value need only be applied to a device row that emits an electron beam, and a voltage equal to or lower than the electron emission threshold value need only be applied to a device row that does not emit an electron beam. From among the common wiring lines $D_{x2}$ to $D_{x9}$ of the device rows, $D_{x2}$ and $D_{x3}$, for example, may be the same wiring line.

Figure 29:
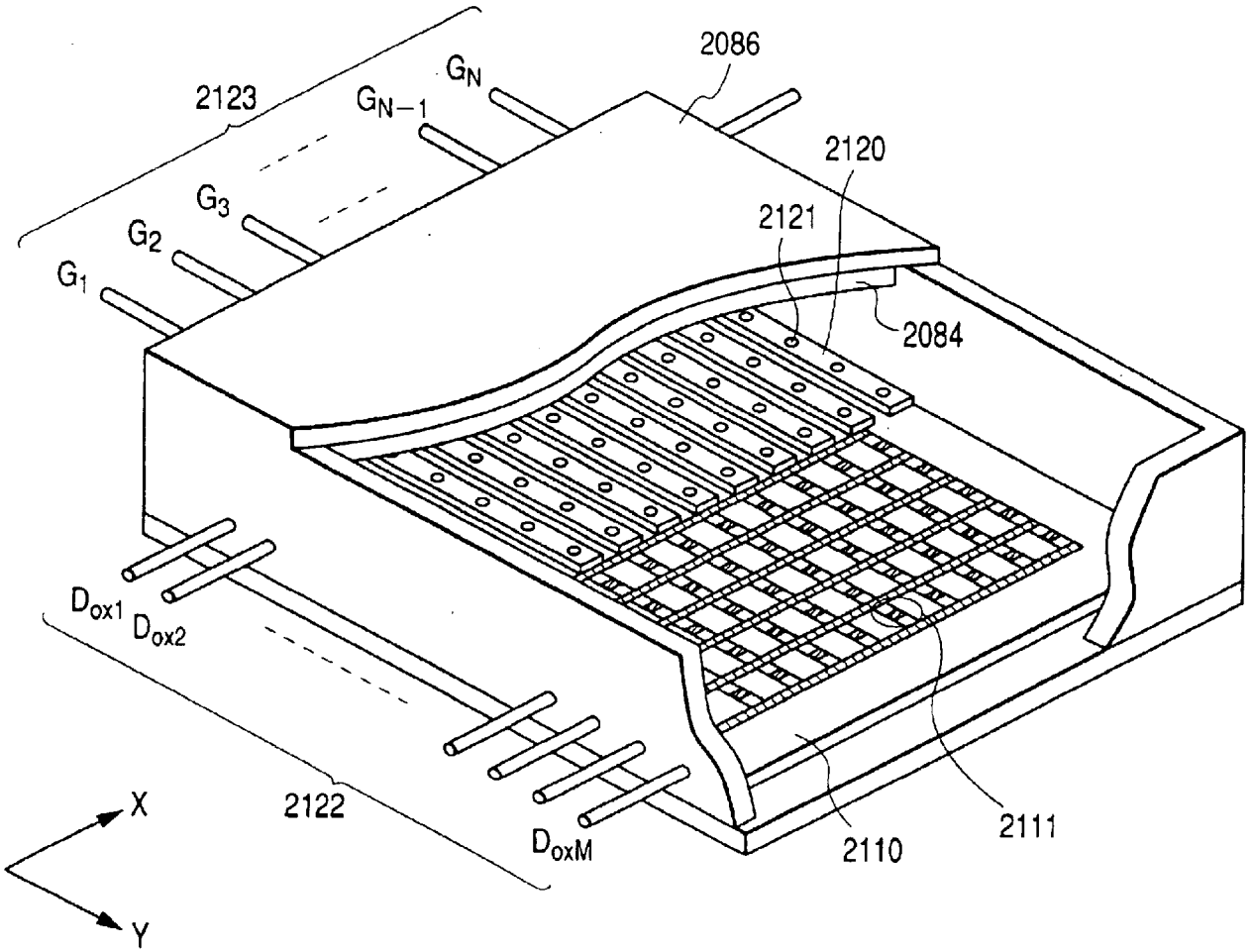
FIG. 29 is a perspective view of an example display panel that includes the ladder-like array electron source in FIG. 28.
Figure 31:
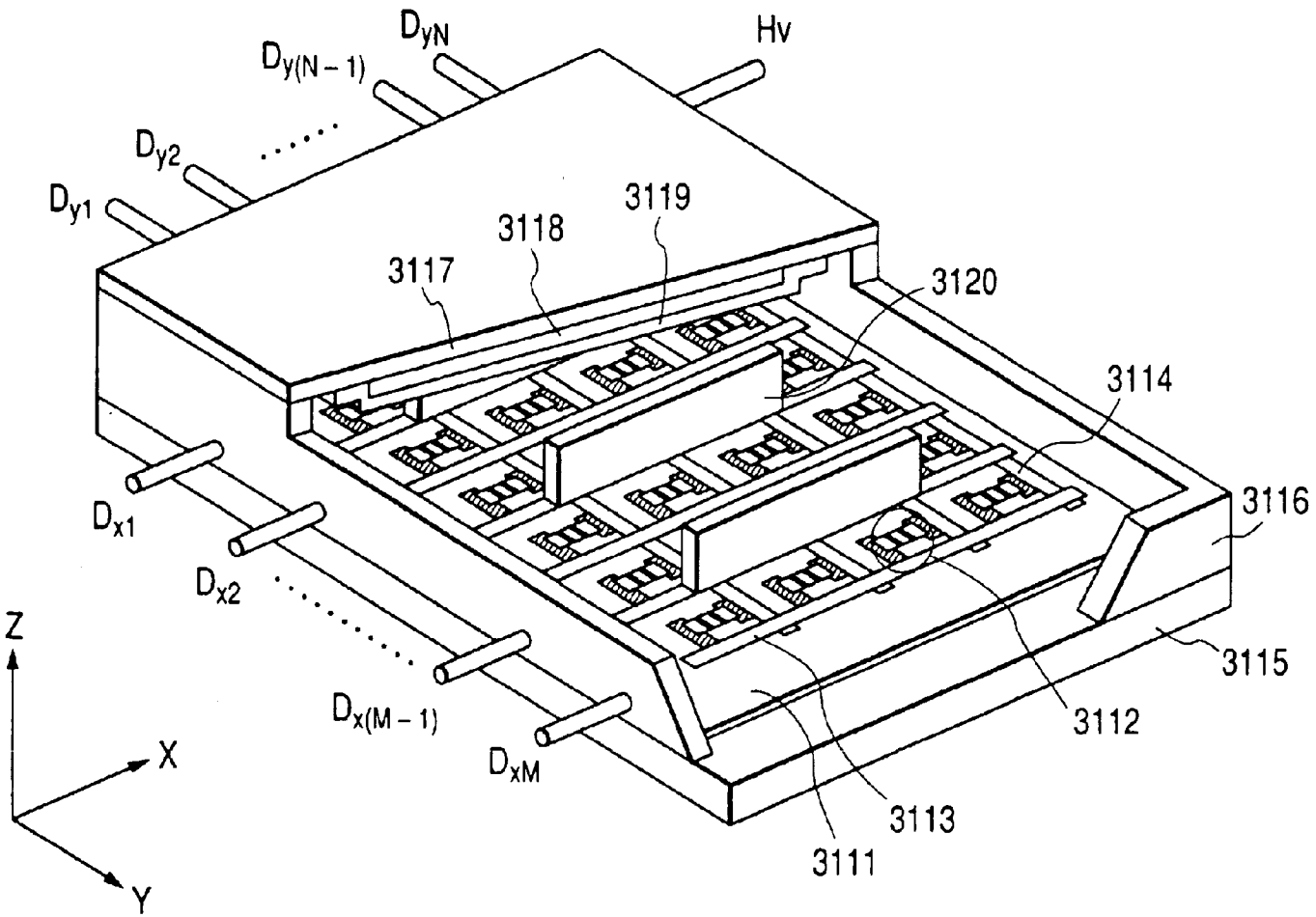
FIG. 31 is a partially cutaway perspective view of a display panel for a conventional image display apparatus that employs a surface conduction electron-emitting device.

FIG. 29 is a diagram showing the structure of a display panel for an image-forming apparatus that includes the ladder-like electron source. In FIG. 29, 2120 denotes grid electrodes; 2121, a through hole to pass through electrons; 2122, external container terminals $D_{ox1}$, $D_{ox2}$, . . . and $D_{OxM}$; 2123, external container terminals of $G_1$, $G_2$, . . . and $G_M$ that are connected to the grid electrodes 2120; and 2110, an electron source substrate wherein the electron-emitting devices are arranged, while, as is described above, the same wiring line is employed for the common wiring between the device rows.

A face plate 1086 is located opposite the electron source substrate 2110 with the grid electrodes 2120 in between. The side walls enclose a gap between the electron source substrate 2124 and the face plate 2086 to maintain a vacuum. A phosphor film 2084 is formed on the surface of the face plate 2086, near the electron source substrate 2110. Further, although not shown, a spacer is provided as an atmospheric pressure resistant: structure between the electron source substrate 2110 and the face plate 2086. The difference between the image-forming apparatus with the ladder-like arrangement and the image-forming apparatus, and the previously described simple matrix arrangement is that the grid electrodes 2120 are provided between the electron source substrate 2110 and the face plate 2086.

As is described above, the grid electrodes 2120 are positioned in the middle of the substrate 2110 and the face plate 2086. The grid electrodes 2120 can modulate electron beams that are emitted by the electron-emitting devices 2111. The circular through hole 2121 is formed for each device in the grid electrodes 2120, so that an electron beam passes through striped electrodes that are formed perpendicular to the device rows in the ladder-like arrangement. The grid shape and the location are not always those shown in FIG. 29. Multiple through holes may be formed like a mesh, or the grid electrodes may be located on the periphery or in the vicinity of the electron-emitting devices 2111.

The external container terminals 2122 and the external grid container terminals 2123 are electrically connected to a control circuit (not shown).

In this image-forming apparatus, a modulation signal for one image line is transmitted to the grid electrode columns in synchronization with the sequential driving (scanning) of each device row. Thus, irradiation of the phosphor by each electron beam can be controlled, and an image can be displayed for each line.

Furthermore, according to the present invention, an image-forming apparatus can be provided that is appropriate not only for a display device for a television broadcast, but also for a display panel for a television conference system or a computer.

Further, according to the idea of the present invention, the above described image-forming apparatus can be employed not only for a display, but also as a replacement for a light emission source, such as a light-emitting diode for an optical printer that includes a photosensitive drum and a light-emitting diode. At this time, when the m row-directional wiring lines and the n column-directional wiring lines described above are selected, the image-forming apparatus can be used not only as a line light-emission source, but also as a two-dimensional light-emission source. In this case, the image-forming member is not limited to a material, such as the phosphor used for this mode, that directly emits light, and a member for forming a latent image by charging the device can be employed. In addition, according to the idea of the present invention, this invention can be applied for a member, other than an image-forming member like a phosphor, that is to be irradiated by electrons emitted by the electron source. Therefore, the present invention can also be a general electron beam apparatus that does not specify a member to be irradiated.

[Embodiments]

The present invention will be described more in detail by using the following embodiments.

In the following embodiments, the above described multi-electron beam source is employed wherein N×M (N=3072, M=1024) surface conduction electron-emitting devices, for which an electron-emitting region is formed in a conductive particle film between electrodes, are arranged in a matrix shape by using M row-directional wiring lines and N column-directional wiring lines, as is shown in FIGS. 1 and 19.

(Embodiment 1)

In this embodiment, the display panel in FIGS. 1 and 2 was fabricated in the following manner.

(1) To fix the substrate 1011 to the rear plate 1015.

First, the row-directional wiring electrode 1013, the column-directional wiring electrode 1014, the inter-electrode insulating layer (not shown) and the device electrodes and the electroconductive film for the cold cathode devices 1012, which are surface conduction electron-emitting devices, were formed on the substrate 1011, and the resultant structure was fixed to the rear plate 1015.

(2) To securely bond the spacer 1020 to the block 1021.

Of the surfaces of the insulating base member 21 (height: 2 mm, plate thickness: 200 μm, length: 550 mm) that were made of soda lime glass and that were heated, extended and cut off, the high resistance film 22 was deposited on the two surfaces that were exposed inside the envelope, and the low resistance film 25 was deposited on the contact face 23. The obtained structure was then employed as a spacer 1020. The high resistance film 22 was a Cr—Al metal nitride film having a thickness of 200 nm and a sheet resistance of about $10^{10}$ [Ω/□], which was obtained by sputtering Cr and Al targets using a high-frequency power source. The low resistance film 25 was formed of Ti (the underlayer of 200 Å) and Pt (800 Å), and had a height of 50 μm and a width of 200 μm. A no-film region of 25 nm was provided at both ends of the film 25. As the shape of the spacer 1020, the non-contact portions 1023 were provided at both ends, as is shown in FIG. 3. The block 1021 was formed of alumina.

The spacer 1020 and the block 1021 were appropriately aligned at the positions and angles, and were fixed together by an ceramic adhesive, so that, when the spacer 1020 was placed inside the display panel in the post-processing and when the envelope was formed or the vacuum discharge was performed, the ends of the spacer 1020 were not grounded obliquely on the face plate 1017 and the rear plate 1015.

(3) To position the spacer 1020 on the rear plate 1015.

The positioning tool was employed to locate the spacer 1020 at a predetermined position inside or outside the electron-emitting region. The spacers 1020 were located, at the same interval, in parallel to and above the row-directional wiring lines 1013 (line width: 200 μm) of the substrate 1011, and were connected together electrically. A ceramic adhesive was used to bond the block 1021 to the rear plate 1015.

(4) To form an envelope.

The face plate 1017 was positioned 2 mm above the substrate 1011 via the side wall 1016. The phosphor film 1018, which consisted of striped color phosphors that extended in the columnar direction (the Y direction), and the metal back 1019 were provided inside the face plate 1017. Frit glass (not shown) was used to coat the joint of the rear plate 1015 and the side wall 1016 and the joint of the face plate 1017 and the side wall 1016, and the resultant structure was annealed in a nitrogen atmosphere at a temperature of 400 to 500° C. As a result, the rear plate 1015, the side wall 1016 and the face plate 1017 were sealed, and the face plate 1017 and the rear plate 1015 were appropriately aligned.

At this time, since the non-contacting portions 1023 were provided at both ends of the spacer 1020, the generation of stress at the spacer ends, which was caused by position and angle shifting that still remained after the adjustment at step (2), and the accompanying destruction of the spacer 1020, could be prevented. Therefore, the yields of the spacer 1020 and the panel in the envelope formation process could be improved.

(5) To perform the vacuum discharge and seal the envelope.

A vacuum pump was employed to discharge air from the thus obtained envelope via an exhaust pipe (not shown). When a satisfactory vacuum degree was reached, a current was transmitted from the external container terminals $D_{x1}$ to $D_{xM}$ and $D_{y1}$, to $D_{yN}$ to the individual devices via the row-directional wiring electrode 1013 and the column-directional wiring electrode 1014. Then, the energization forming operation and the energization activation operation previously described were performed to manufacture the multi-electron beam source.

Following this, at degree of vacuum of approximately $1.3\times10^{-3}$ [Pa] (10.6 [Torr]), the exhaust pipe (notshown) was heated and melted by a gas burner to close the envelope. Finally, the getter process was performed to maintain the vacuum inside the sealed envelope.

Specifically, after the vacuum discharge was performed for the envelope, the spacer 1020 was fixed at a predetermined position in the envelope by the external exertion of atmospheric pressure on the envelope. Also at this time, since the non-contacting portions 1023 were present at both ends of the spacer 1020, the generation of stress at the spacer ends, which was caused by the position and angle shifting that still remained after the adjustment at step (2), was eliminated and the accompanying destruction of the spacer could be prevented. Further, the yields of the spacer 1020 and the panel in the vacuum discharge process could be increased.

In the image display apparatus that employs the thus obtained display panel shown in FIG. 1, a scan signal and a modulation signal were transmitted by signal generation means (not shown) via the external container terminals $D_{x1}$ to $D_{xM}$ and $D_{y1}$ to $D_{yN}$ to emit electrons, and a high voltage was applied to the metal back 1019, via the high-voltage terminal Hv, to accelerate the emitted electron beam. Then, the individual phosphors were excited by electrons that struck the phosphor film 1018 and light was emitted to display an image. The voltage Va, which ranged from 3 to 12 [kV], was gradually applied to the high-voltage terminal Hv until it reached the limit voltage whereat a discharge occurs, and the voltage Vf of 14 [V] was applied to the wiring lines 1013 and 1014. When the voltage of 8 kV or higher was applied to the high-voltage terminal Hv and when continuous driving for one hour or longer was enabled, it was determined that the voltage withstandability was satisfactory.

At this time, the voltage withstandability was satisfactory in the vicinity of the spacer 1020. Further, the arrays of light spots, including a spot formed by an electron that was emitted by the cold cathode device 1012 near the spacer 1020, were formed at the same interval and in two dimensions. As a result, a clear color image could be displayed that had superior color reproductivity.

(Embodiment 2)

In this embodiment, a spacer 1020' that was shaped as shown in FIG. 8 was employed. In this embodiment, the width (height) of the non-contact portions 1023 of the spacer 1020' was approximately 1 mm, and the display panel was fabricated in the same manner as in Embodiment 1. As a result, no fissure occurred at the ends of the spacer 1020'. Further, when the obtained display panel was employed to display an image, as in Embodiment 1, the arrays of light spots were also formed at the same interval and in two dimensions, and a clear color image could be displayed that had superior color reproductivity.

(Embodiment 3)

Figure 9:
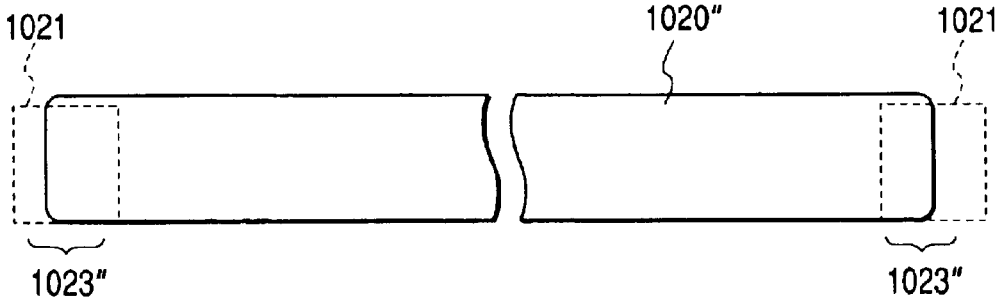
FIG. 9 is a side view of another modification of the non-contacting portions of the spacer according to the mode in FIG. 1.

In this embodiment, the spacer 1020", which is shown in FIG. 9, was employed. In this embodiment, the curvature radius of the corner of each non-contacting portion 1023" of a spacer 1020" was approximately 30 $\mu$m. When the display panel was fabricated in the same manner as in Embodiment 1, no fissure occurred at the ends of the spacer 1020". Further, when the obtained display panel was employed to display an image, as in Embodiment 1, the arrays of light spots were also formed at the same interval in two dimensions, and a clear color image could be displayed that had superior color reproductivity.

(Embodiment 4)

In this embodiment, the spacer 1120 in FIG. 10 was employed, and the display panel was manufactured in the same manner as in Embodiment 2. Specifically, Embodiment 4 is the same as Embodiment 1, except that the block 1121 was fixed to the substrate 1111, and that the spacer 1120 was inserted into the grooves 1122 of the block 1121 and was mounted on the substrate 1111.

In the process for manufacturing the display panel, the spacer 1120 could be bent to a degree without being destroyed, when it contacted the face plate during the formation of the envelope, or when the vacuum discharge was performed in the envelope. That is, when the warped spacer 1120 was reshaped relative to the substrate 1111 and the face plate, the generated stress could be dispersed across the spacer 1120, and destruction of the spacer 1120 could be prevented. When the obtained display panel was employed to display an image, as in Embodiment 1, the arrays of light spots were also formed at the same interval and in two dimensions, and a clear color image could be displayed that had superior color reproductivity.

(Embodiment 5)

In this embodiment, the display panel was fabricated in the same manner as in Embodiment 3. That is, the spacer 1120 in FIG. 10 was fixed, by an epoxy resin, to the block 1121, which was made of acrylic resin, and the resultant structure was mounted on the substrate 1111. Then, as in Embodiment 1, the envelope and the multi-electron beam source were manufactured and the discharge was performed for the envelope.

As a result, when the relative positioning or the relative angle was changed between the block 1121 and the spacer 1120 during the display panel assembly process, the generated stress was dispersed by the block 1121, and the spacer 1120 was not destroyed. When the obtained display panel was employed to display an image as in Embodiment 1, the arrays of light spots were also formed at the same interval and in two dimensions, and a clear color image could be displayed that had superior color reproductivity.

(Embodiment 6)

This embodiment corresponds to Embodiment 4. That is, the insulating base member that serves as the spacer had a thermal expansion ratio smaller than the substrate and the face plate. Specifically, PD200 glass manufactured by Asahi Glass Co., Ltd. was employed as the insulating base member that served as the spacer, and soda lime glass was employed as a member that served as the envelope. The difference in the thermal expansion ratios of PD glass and soda lime glass does not exceed 5%. The display panel fabrication process accompanied by the heating to a temperature of about 400° C. was conducted for approximately 200 spacers, and no fissures or distortion occurred in the spacers. Further, when the obtained display panel was employed to display an image, as in Embodiment 1, the arrays of light spots were formed at the same interval and in two dimensions, and a clear color image could be displayed with superior color reproductivity.

(Embodiment 7)

This embodiment corresponds to Embodiment 5. that is, as is shown in FIG. 15, the low resistance film 1225 of the spacer 1220 was formed at separate locations along the longitudinal direction of the spacer 1220. The low resistance film 1225 was deposited by sputtering, while a plurality of film deposition masks were placed on the film segments. As a result, positional precision of the low resistance film 1225 was improved, compared with when only one film deposition mask was employed to form a continuous film in the longitudinal direction. Furthermore, the low resistance films 1225 were formed at separate positions by a transfer method, whereby a solvent containing the film deposition material was coated on the plane, and the ends of the spacer contacted the solvent to transfer the film deposition material. As a result, the positional precision was increased, compared with when the continuous film was formed in the longitudinal direction.

The display panel was fabricated using the obtained spacer 1220, and an image was displayed thereon as in Embodiment 1. Then, as in Embodiment 1, the arrays of light spots were formed at the same interval and in two dimensions, and a clear color image could be displayed that had superior color reproductivity.

(Embodiment 8)

Figure 18:
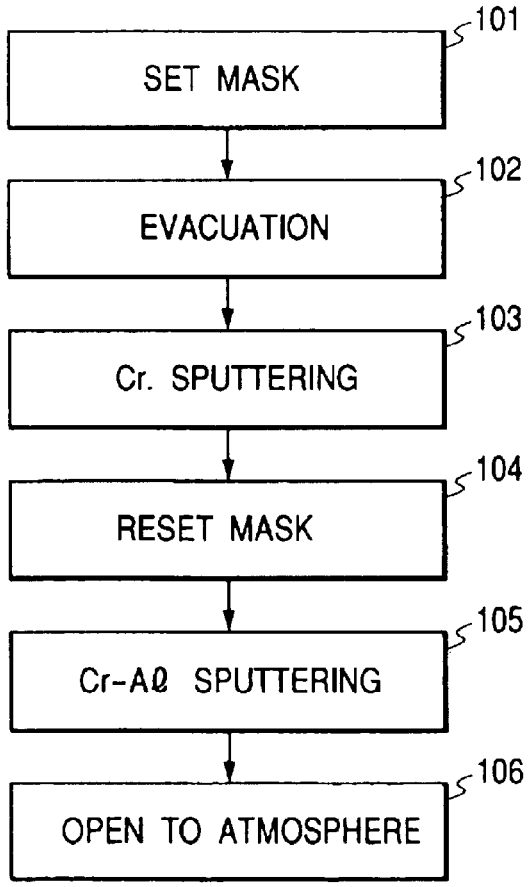
FIG. 18 is a flowchart showing example processing for manufacturing the spacer in FIG. 17.

This embodiment corresponds to Embodiment 6, and the low resistance film 1325 and the high resistance film 1322 of the spacer 1320 in FIG. 17 were deposited in the processing shown in FIG. 18. That is, a film deposition device that includes Cr and Al targets and can sputter the two at the same time was employed to form the low resistance film 1325 (Cr film of 1000 Å thick) and the high resistance film 1322 (Cr—Al alloy nitride film of 2000 Å), as the films that contained the same element (Cr) and that were to be formed on the insulating base member 1321. First, the low resistance film 1325 was deposited, while the low resistance film deposition mask contacted the insulating base member 1321, and then, the high resistance film 1322 was deposited: after the deposition mask was retracted by automatic feeding.

Following this, the display panel was fabricated by using the obtained spacer 1320, and an image was displayed thereon, as in Embodiment 1. As a result, as in Embodiment 1, the arrays of light spots were formed at the same interval and in two dimensions, and a clear color image could be displayed that had superior color reproductivity.

In the above embodiments, specific examples are shown wherein the present invention is applied for a spacer that is directly sandwiched by the first and the second substrates. However, in the arrangement where the intermediate members, such as grid electrodes, are present between the first and the second substrate, the present invention can also be applied for a spacer that is sandwiched between the intermediate member and the first substrate, and a spacer that is sandwiched between the intermediate member and the second substrate.

As is described above, the following effects can be obtained for the present invention.

According to the first invention wherein either the spacer or the support member has a structure for reducing the stress that is generated when the spacer is sandwiched between the first and the second substrates, during the assembly of the electron beam apparatus, the spacer can be self-supported by the support member on the first or the second substrate. Therefore, the spacer can be easily attached, and as a result, the assembly costs can be reduced. Further, the stress reduction mechanism can reduce the stress that is generated between the spacer and the supporting portion of the support member when the spacer is held by the support member, so that the destruction of the spacer can be prevented. In addition, since the support member is located outside the electron-emitting regions, the support member does not adversely affect the array of the electron-emitting devices, and the devices can be closely arranged.

Furthermore, according to the second invention wherein, when the support member is mounted on the first or the second substrate, the spacer is fixed to the support member, so that the axis of the spacer in the longitudinal direction is substantially parallel to the face whereon the support member is mounted, and when the spacer is sandwiched between the first and the second substrates during the assembly of the electron beam apparatus, only the minimum stress is generated at the portion to which the spacer and the support member are fixed, and the destruction of the spacer can be prevented.

According to the third invention wherein a spacer is employed that has a smaller thermal expansion ratio than the first and the second substrates, the spacer is prevented from being bent due to heat that is generated during the formation of the envelope, and the position shifting of the spacer can be prevented.

According to the fourth invention whereby, on the surface of the spacer, a charge prevention film is formed at a plurality of positions in the longitudinal direction of the spacer, the precision for the depositing of the charge prevention film can be increased, even for a long spacer, and a desired film can be obtained.

According to the fifth invention where the low resistance film and the high resistance film, which are to be formed on the surface of the spacer, contain the same metal element but have different compositions, the same film deposition device can be employed to sequentially form the low resistance film and the high resistance film. Therefore, the number of steps required for fabricating the spacer can be reduced, and satisfactory electrical conductivity is ensured between the low resistance film and the high resistance film.

What is claimed is:

1. An electron beam apparatus comprising:

a first substrate that includes a plurality of electron-emitting devices, wherein said plurality of electron-emitting devices are provided in a vacuum container, a second substrate that is located opposite said first substrate and that has a region irradiated by electrons emitted by said electron-emitting devices in said vacuum container;

at least one spacer that is mounted as an atmospheric-pressure resistant structure, that is sandwiched directly between said first and second substrates, or indirectly via an intermediate member between said first and second substrates, and that is extended longitudinally in a direction perpendicular to a direction in which said first and second substrates are positioned opposite each other; and a support member, for supporting said spacer outside an electro-emitting region that is defined between a region of said first substrate wherein said electron-emitting devices are located, and a region of said second substrate that is irradiated by said electrons, wherein said spacer has, in a vicinity of an end in a longitudinal direction, a portion shorter in a width direction of a gap between said first and second substrates rather than in another portion.

2. An electron beam apparatus according to claim 1, wherein said support member is fixed to said first or said second substrate, and wherein ends of said spacer are inserted into grooves formed in said support member.

3. An electron beam apparatus according to claim 1, wherein said support member is formed of a material that is softer than said spacer.

4. An electron beam apparatus according to claim 1, wherein said support member is shorter than said spacer in a direction in which said first substrate faces said second substrate.

5. An electron beam apparatus comprising:

a first substrate that includes a plurality of electron-emitting devices, wherein said plurality of electron-emitting devices are provided in a vacuum container, a second substrate that is located opposite said first substrate and that has a region irradiated by electrons emitted by said electron-emitting devices;

at least one spacer that is mounted as an atmospheric pressure resistant structure that is sandwiched directly between said first and second substrates, or indirectly via an intermediate member between said first and second substrates, and that is extended longitudinally in a direction perpendicular to a direction in which said first and second substrates are positioned opposite each other; and a support member that, outside an electron-emitting region that is defined between a region of said first substrate wherein said electron-emitting devices are located and the region on said second substrate that is irradiated by said electrons, is mounted on said substrate whereon said spacer is provided so that said support member supports said spacer, wherein said support member and said spacer are secured to each other, so that said spacer is straightened without warpage in a state of being secured to said support member, and a direction in parallel to a mounting surface of said substarate on which said supporting member is mounted, is in parallel to a longitudinal direction of said spacer.

6. An electron bean apparatus according to claim 5, wherein said support member is shorter than said spacer in a direction in which said first substrate faces said second substrate.

7. An electron beam apparatus comprising:

a first substrate that includes a plurality of electron-emitting devices, wherein said plurality of electron-emitting devices are provided in a vacuum container;

a second substrate that is located opposite said first substrate and that has a region irradiated by electrons emitted by said electron-emitting devices;

at least one spacer that is mounted as an atmospheric-pressure resistant structure, that is sandwiched directly between said first and second substrates, or indirectly via an intermediate member between said first and second substrates, and that is extended longitudinally in a direction perpendicular to a direction in which said first and second substrates are positioned opposite each other; and a support member, for supporting said spacer outside an electron-emitting region that is defined between a region of said first substrate wherein said electron-emitting devices are located, and a region of said second substrate that is irradiated by said electrons, wherein said spacer has a thermal expansion rate that is smaller than a thermal expansion rate of said substrate.

8. An electron beam apparatus according to claim 7, wherein a difference between the thermal expansion ratio of said substrate and the thermal expansion ratio of said spacer does not exceed 5%.

9. An electron beam apparatus according to claim 7, wherein said support member supports a plurality of said spacers.

10. An electron beam apparatus according to claim 9, wherein, while said support member is fixed to said spacer, said support member is fixed, to said substrate.

11. An electron beam apparatus according to claim 1, wherein said support members support one or both longitudinal ends of said spacer.

12. An electron beam apparatus according to claim 5 wherein said support members support one or both longitudinal ends of said spacer.

13. An electron beam apparatus according to claim 7, wherein said support members support one or both longitudindal ends of said spacer.

14. An electron beam apparatus according to claim 1, wherein, in said electron-emitting region, a film that is charged less easily than a surface of a base member that serves as said spacer is deposited on a surface of said spacer that is exposed in said vacuum container.

15. An electron beam apparatus according to claim 5, wherein, in said electron-emitting region, a film that is charged less easily than a surface of a base member that serves as said spacer is deposited on a surface of said spacer that is exposed in said vacuum container.

16. An electron beam apparatus according to claim 7, wherein, in said electron-emitting region, a film that is charged less easily than a surface of a base member that serves as said spacer is deposited on a surface of said spacer that is exposed in said vacuum container.

17. An electron beam apparatus according to claim 14, 15 or 16, wherein said second substrate includes an electrode for controlling electrons that are emitted by said electron-emitting devices, and wherein said film is, at the least, electrically connected to either said first substrate or said electrode.

18. An electron beam apparatus according to claim 17, wherein said film includes a high resistance film having a sheet resistance of $10^7$ Ω/□ to $10^{14}$ Ω/□.

19. An electron beam apparatus according to claim 18, wherein, at least in a region in which said film is electrically connected, said film includes a low resistance film having a sheet resistance equal to or smaller than 1/10 of said high resistance film, and equal to or higher than $10^7$ Ω/□.

20. An electron beam apparatus according to claim 14, 15 or 16, wherein at least one part of said film has a secondary electron emission coefficient of two or smaller.

21. An electron beam apparatus according to claim 1, wherein said electron-cutting devices are connected by wiring laid on said first substrate, and a film formed on said spacer is electrically connected to said wiring.

22. An electron beam apparatus according to claim 5, wherein said electron-emitting devices are connected by wiring laid on said first substrate, and a film formed on said spacer is electrically connected to said first substrate by said wiring.

23. An electron beam apparatus according to claim 7, wherein said electron-emitting devices are connected by wiring laid on said first substrate, and a film formed on said spacer is electrically connected to said first substrate by said wiring.

24. An electron beam apparatus according to claim 1, wherein an image-forming member, for forming an image by irradiation of electrons that are emitted by said electron-emitting devices, is provided for said second substrate.

25. An electron beam apparatus according to claim 5, wherein an image-forming member, for forming an image by irradiation of electrons that are emitted by said electron-emitting devices, is provided for said second substrate.

26. An electron beam apparatus according to claim 7, wherein an image-forming member, for forming an image by irradiation of electrons that are emitted by said electron-emitting devices, is provided for said second substrate.

27. An electron beam apparatus according to claim 1, wherein said spacer is fixed at a position at an end side thereof rather than said portion.

28. An electron beam apparatus according to claim 1, wherein said spacer has a section of which length in a direction along which said first and second substrates are opposed to each other is gradually made shorter in a vicinity of the end of the longitudinal direction.

29. A method of manufacturing a structure comprising a first substrate, a second substrate, and a spacer extending against an atmospheric pressure, sandwiched directly or indirectly between said first and second substrates, the method comprising the steps of:

straightening said spacer to remove warpage therefrom;

fixing said spacer to a supporting member supporting said spacer in a state such that a warpage of said spacer is straightened;

disposing said spacer fixed to said supporting member onto said first substrate; and disposing said first and second substrates in opposition to each other.

30. The method according to claim 29, wherein said step of fixing said spacer to said supporting member is conducted so that a direction in parallel to a mounting surface of said first substrate on which said supporting member is mounted is in parallel with a longitudinal direction of said spacer disposed on said first substrate, and a warpage of said spacer in a direction along which said first and second substrates are opposed to each other is straightened.

31. A method of manufacturing a structure comprising a first substrate, a second substrate and a spacer extending against an atmospheric pressure directly or indirectly between said first and second substrates, the method comprising the steps of:

fixing said spacer to a supporting member supporting said spacer in a state such that said spacer is weighted;

disposing said spacer fixed to said supporting member onto said first substrate; and disposing said second substrate in opposition to said first substrate.

32. The method according to claim 31, wherein said step of fixing said spacer to said supporting member includes a process of weighting to said spacer in a direction along which said first and second substrates are opposed to each other.

33. An electron beam apparatus comprising:

a first substrate provided with a plurality of electron-emitting devices, wherein the plurality of electron-emiting devices are positioned in a vacuum container;

a second substrate provided with an electrode for controlling an electron emitted from at least one of the electron-emitting devices, and provided in opposition to the first substrate; and a spacer sandwiched directly or indirectly between the first and second substrates, and having a structure withstanding an atmospheric pressure, wherein the spacer is provided with a first film disposed on a plane of the spacer in opposition to either the first substrate or the electrode, and a second film which covers the first film so that the second film is disposed between the first film and either the first substrate or the electrode opposed to the first film, the first film has a smaller sheet resistance than that of the second film, and the first and second films contain a same metal element and have different compositions.

34. The apparatus according to claim 33, wherein the first and second films are formed according to a vapor phase growth method, successively, within a same chamber, without releasing a vacuum state of an atmosphere within the chamber.

35. The apparatus according to claim 33, wherein the sheet resistance of the first film is not larger than 1/10 of that of the second film.

36. The apparatus according to claim 33, wherein the first film has a sheet resistance not larger than $10^7$ Ω/□.

37. The apparatus according to claim 33, wherein the second film is connected to the first substrate or the electrode to which the first film covered by the second film opposes.

38. The apparatus according to claim 33, wherein each of the electron-emitting devices is wired by wirings formed on the first substrate, the first film is disposed in opposition to the first substrate, an electrical connection between the second film covering the first film and the first substrate is formed through an electrical connection between the second film and at least one wiring.

39. The apparatus according to claim 33, wherein the electrode is an acceleration electrode for accelerating the electron emitted from the at least one electron-emitting device.

40. The apparatus according to claim 33, wherein a longitudinal direction of the spacer is vertical relative to a direction along which the first and second substrates oppose one another.

41. The apparatus according to claim 33, wherein the second film has a smaller capability of electrical charging than does a surface of the spacer.

42. The apparatus according to claim 3, wherein the second film is a high resistance film.

43. The apparatus according to claim 33, further comprising an image forming member for forming an image by irradiating the second substrate with the electron emitted from the at least one electron-emitting device.

* * * * *

UNITED STATES PATENT AND TRADEMARK OFFICE

CERTIFICATE OF CORRECTION

PATENT NO. : 6,803,715 B1
DATED : October 12, 2004
INVENTOR(S) : Mitsutake et al.

It is certified that error appears in the above-identified patent and that said Letters Patent is hereby corrected as shown below:

Column 2,
Line 11, “a” (second occurrence) should be deleted.

Column 4,
Line 22, “can not” should read -- cannot --; and
Line 41, “can not” (both occurrences) should read -- cannot --.

Column 6,
Line 10, “substrate;” should read -- substrate, --.

Column 11,
Line 19, “is” should read -- are --; and
Line 61, “can not” should read -- cannot --.

Column 13,
Line 66, “above described” should read -- above-described --.

Column 16,
Line 36, “While the” should read -- The --.

Column 17,
Line 6, “above described” should read -- above-described --.

Column 21,
Line 19, “charged” should read -- be charged --; and
Line 35, “is” should be deleted.

Column 22,
Line 58, “above described” should read -- above-described --.

Column 24,
Line 10, “above described” should read -- above-described --; and
Lines 28 and 32, “As” should read -- A° --.

Column 26,
Line 30, “can not” should read -- cannot --; and
Line 55, “above described” should read -- above-described --.

Column 27,
Line 64, “$I'_{dM}$),” should read -- $I'_{dN}$ --; and
Line 66, “$I'_{dM}$ More” should read -- $I'_{dN}$. More --.

UNITED STATES PATENT AND TRADEMARK OFFICE

CERTIFICATE OF CORRECTION

PATENT NO. : 6,803,715 B1
DATED : October 12, 2004
INVENTOR(S) : Mitsutake et al.

It is certified that error appears in the above-identified patent and that said Letters Patent is hereby corrected as shown below:

Column 28,
Line 41, "above described" should read -- above-described --.

Column 29,
Line 11, "$G_M$" should read -- $G_N$ --; and
Line 58, "above described" should read -- above-described --.

Column 30,
Line 12, "above described" should read -- above-described --.

Column 31,
Line 32, "(10.6 [Torr])," should read -- ($10^{-6}$ [Torr]) --.

Column 33,
Line 20, "that" should read -- That --; and
Line 56, "deposited:" should read -- deposited --.

Column 38,
Line 59, "claim 3," should read -- claim 33, --; and
Line 62, "prising" should read -- prising: --.

Signed and Sealed this

Fourth Day of April, 2006

JON W. DUDAS
*Director of the United States Patent and Trademark Office*